US011440085B2

(12) United States Patent
Okada et al.

(10) Patent No.: US 11,440,085 B2
(45) Date of Patent: Sep. 13, 2022

(54) MOLD EQUIPMENT AND CONTINUOUS CASTING METHOD

(71) Applicant: NIPPON STEEL CORPORATION, Tokyo (JP)

(72) Inventors: Nobuhiro Okada, Tokyo (JP); Shintaro Oga, Tokyo (JP); Yuichi Tsukaguchi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/043,573

(22) PCT Filed: Jun. 19, 2019

(86) PCT No.: PCT/JP2019/024260
§ 371 (c)(1),
(2) Date: Sep. 29, 2020

(87) PCT Pub. No.: WO2020/017224
PCT Pub. Date: Jan. 23, 2020

(65) Prior Publication Data

US 2021/0023610 A1 Jan. 28, 2021

(30) Foreign Application Priority Data

Jul. 17, 2018 (JP) ..... JP2018-134408

(51) Int. Cl.
*B22D 11/115* (2006.01)
*B22D 11/16* (2006.01)
(Continued)

(52) U.S. Cl.
CPC ..... *B22D 11/115* (2013.01); *B22D 11/16* (2013.01); *B22D 11/04* (2013.01); *B22D 11/122* (2013.01)

(58) Field of Classification Search
CPC ..... B22D 11/049; B22D 11/11; B22D 11/115; B22D 11/122; B22D 11/16
See application file for complete search history.

(56) References Cited

U.S. PATENT DOCUMENTS 3,358,743 A * 12/1967 Adams ..... B22D 11/16 164/450.2
5,746,268 A * 5/1998 Fujisaki ..... B22D 11/115 164/468
(Continued)

FOREIGN PATENT DOCUMENTS

| | | | |
|---|---|---|---|
| CA | 2 364 085 | C | 5/2007 |
| JP | 4-9255 | A | 1/1992 |
| JP | 2008-137031 | A | 6/2008 |

*Primary Examiner* — Kevin E Yoon
(74) *Attorney, Agent, or Firm* — Birch, Stewart, Kolasch & Birch, LLP

(57) ABSTRACT

This mold equipment is mold equipment provided with a mold, an electromagnetic brake device, and a control device. An immersion nozzle is provided with a pair of discharge holes of molten metal, the electromagnetic brake device is provided with an iron core including a pair of teeth and coils wound around the respective teeth, the coils on one side are connected in series in a first circuit, the coils on the other side are connected in series in a second circuit, and the control device is able to independently control voltage and current applied to each of the first and second circuits for each circuit, detects a drift of a discharge flow between the pair of discharge holes on the basis of the voltage applied to the coils in the first circuit and the voltage applied to the coils in the second circuit, and controls the current flowing through the first circuit and the current flowing through the second circuit on the basis of a detection result.

5 Claims, 14 Drawing Sheets

(51) Int. Cl.
*B22D 11/04* (2006.01)
*B22D 11/12* (2006.01)

(56) References Cited

U.S. PATENT DOCUMENTS

| | | | | |
|---|---|---|---|---|
| 2011/0209847 | A1* | 9/2011 | Toh | B22D 11/115 164/504 |
| 2017/0216909 | A1* | 8/2017 | Lehman | B22D 11/04 |
| 2020/0156146 | A1* | 5/2020 | Seden | B22D 11/049 |

* cited by examiner

10

MOLD EQUIPMENT AND CONTINUOUS CASTING METHOD

TECHNICAL FIELD OF THE INVENTION

The present invention relates to mold equipment and a continuous casting method.

Priority is claimed on Japanese Patent Application No. 2018-134408, filed in Japan on Jul. 17, 2018, the content of which is incorporated herein by reference.

RELATED ART

In continuous casting, by injecting molten metal (for example, molten steel) temporarily stored in a tundish from above into a mold through an immersion nozzle, and pulling out a slab of which outer peripheral surface is cooled there to be solidified from a lower end of the mold, casting is continuously performed. A solidified portion of the outer peripheral surface of the slab is referred to as a solidified shell.

Herein, the molten metal contains gas bubbles of an inert gas (for example, Ar gas) supplied together with the molten metal to prevent clogging of a discharge hole of the immersion nozzle, non-metallic inclusions and the like; if these impurities remain in the slab after casting, they cause deterioration in quality of a product. In general, a specific gravity of the impurities is smaller than a specific gravity of the molten metal, so that they are often floated up in the molten metal to be removed during the continuous casting. Therefore, when a casting speed is increased, floating separation of the impurities is not sufficiently performed, and the quality of the slab tends to be deteriorated. In this manner, in the continuous casting, there is a trade-off relationship between productivity and the quality of the slab, that is, there is a relationship that, when pursuing the productivity, the quality of the slab is deteriorated, and when the quality of the slab is prioritized, the productivity is deteriorated.

In recent years, a quality required for some products such as automobile exterior materials becomes stricter year by year. Therefore, in the continuous casting, there is a tendency that operation is performed at the expense of the productivity in order to secure the quality. In view of such circumstances, in the continuous casting, there has been a demand for a technology of further improving the productivity while securing the quality of the slab.

In contrast, it is known that the quality of the slab is significantly affected by a flow of the molten metal in the mold during the continuous casting. Therefore, by appropriately controlling the flow of the molten metal in the mold, it may be possible to realize high-speed stable operation, that is, improve the productivity, while maintaining a desired quality of the slab.

In order to control the flow of the molten metal in the mold, a technology using an electromagnetic force generating device which applies an electromagnetic force to the molten metal in the mold is developed. Meanwhile, in the present specification, a group of members around the mold including the mold and the electromagnetic force generating device is also referred to as mold equipment for convenience.

For example, a device provided with an electromagnetic brake device and an electromagnetic stirring device is widely used as an electromagnetic force generating device for controlling the flow of the molten metal in the mold. Herein, the electromagnetic brake device is a device which applies a static magnetic field to the molten metal to generate a braking force in the molten metal, thereby suppressing the flow of the molten metal. In contrast, the electromagnetic stirring device is a device which applies a moving magnetic field to the molten metal to generate an electromagnetic force referred to as a Lorentz force in the molten metal, thereby applying a flow pattern which swirls in a horizontal plane of the mold to the molten metal.

The electromagnetic brake device is generally provided so as to generate a braking force in the molten metal which weakens a power of the discharge flow ejected from the immersion nozzle. Herein, the discharge flow from the immersion nozzle collides with an inner wall of the mold, thereby forming an upward flow in a direction upward (that is, a direction in which a molten metal bath level exists) and a downward flow in a direction downward (that is, a direction in which the slab is pulled out). Therefore, the electromagnetic brake device weakens the power of the discharge flow, so that the power of the upward flow is weakened and variation in molten metal bath level may be suppressed. Since the power of the discharge flow colliding with the solidified shell is also weakened, an effect of suppressing breakout due to remelting of the solidified shell may also be exerted. In this manner, the electromagnetic brake device is often used for the purpose of high-speed stable casting. Furthermore, according to the electromagnetic brake device, since a flow speed of the downward flow formed by the discharge flow is suppressed, the floating separation of impurities in the molten metal is accelerated, and an effect of improving an internal quality of the slab may be obtained.

In contrast, a disadvantage of the electromagnetic brake device is that the flow speed of the molten metal at a solidified shell interface becomes low, which might deteriorate a surface quality of the slab. Since it is difficult for the upward flow formed by the discharge flow to reach the bath level, there is a concern that bath level temperature decreases and skinning occurs, causing internal quality defects.

The electromagnetic stirring device applies a predetermined flow pattern to the molten metal as described above, that is, generates a swirling flow in the molten metal. As a result, the flow of the molten metal at the solidified shell interface is accelerated, so that the above-described impurities such as Ar gas bubbles and non-metallic inclusions are suppressed from being captured by the solidified shell, and the surface quality of the slab may be improved.

In contrast, a disadvantage of the electromagnetic stirring device is that, as the swirling flow collides with the inner wall of the mold, the upward flow and the downward flow are generated as the discharge flow from the immersion nozzle described above, so that the upward flow involves molten powder and the like on the bath level and the downward flow sweeps away the impurities to a lower side of the mold, thereby deteriorating the inner quality of the slab.

As described above, the electromagnetic brake device and the electromagnetic stirring device have the advantage and disadvantage from the viewpoint of securing the quality of the slab (in the present specification, this intends to mean the surface quality and internal quality). Therefore, for the purpose of improving both the surface quality and the internal quality of the slab, a technology of performing the continuous casting using the mold equipment in which both the electromagnetic brake device and the electromagnetic stirring device are provided for the mold has been developed. For example, Patent Document 1 discloses mold equipment provided with an electromagnetic stirring device in an upper portion and an electromagnetic brake device in a lower portion on an outer side surface of a long side mold plate of a mold.

Patent Document 2 discloses a technology in which separate electromagnetic brake devices are arranged outside each of a pair of short side mold plates in a mold.

CITATION LIST

Patent Document

[Patent Document 1]
Japanese Unexamined Patent Application, First Publication No. 2008-137031
[Patent Document 2]
Japanese Unexamined Patent Application, First Publication No. H4-9255

SUMMARY OF INVENTION

Problems to be Solved by the Invention

However, it was found that a drift of a discharge flow due to closure of a discharge nozzle is generated, and a quality of a slab might be deteriorated in the continuous casting using the electromagnetic force generating device as disclosed in Patent Document 1 and Patent Document 2.

The present invention is achieved in view of the above-described problem, and an object thereof is to provide mold equipment and a continuous casting method capable of further improving a quality of a slab.

Means for Solving the Problem (1) A first aspect of the present invention is mold equipment provided with a mold for continuous casting, an electromagnetic brake device that applies an electromagnetic force in a direction to brake a discharge flow to the discharge flow of molten metal from an immersion nozzle into the mold, and a control device that controls a power supply to the electromagnetic brake device. The immersion nozzle is provided with a pair of discharge holes of the molten metal on both sides in a mold long side direction of the mold. The electromagnetic brake device is installed on an outer side surface of each of a pair of long side mold plates in the mold, and is provided with an iron core including a pair of teeth provided so as to face the long side mold plate on both sides of the immersion nozzle in the mold long side direction, and coils wound around the respective teeth. The coils on one side in the mold long side direction of electromagnetic brake devices are connected in series in a first circuit. The coils on the other side in the mold long side direction of the electromagnetic brake devices are connected in series in a second circuit. The control device is able to independently control voltage and current applied to each of the first and second circuits for each circuit, detects a drift of the discharge flow between the pair of discharge holes on the basis of the voltage applied to the coils in the first circuit and the voltage applied to the coils in the second circuit, and controls the current flowing through the first circuit and the current flowing through the second circuit on the basis of a detection result.

(2) In the mold equipment according to (1) described above, the control device may detect the drift on the basis of a difference between an electromotive force generated in the first circuit due to a change over time in a flow state of the discharge flow from the discharge hole on one side in the mold long side direction and an electromotive force generated in the second circuit due to a change over time in a flow state of the discharge flow from the discharge hole on the other side in the mold long side direction, and may control, in a case of detecting the drift, the current flowing through the first circuit and the current flowing through the second circuit such that the difference between the electromotive force generated in the first circuit and the electromotive force generated in the second circuit becomes small.

(3) In the mold equipment according to (1) or (2) described above, an electromagnetic stirring device that applies an electromagnetic force for generating a swirling flow in a horizontal plane to the molten metal in the mold, the electromagnetic stirring device installed above the electromagnetic brake device may further be provided.

(4) A second aspect of the present invention is a continuous casting method of performing continuous casting while applying an electromagnetic force in a direction to brake a discharge flow to the discharge flow of molten metal from an immersion nozzle into the mold by an electromagnetic brake device, in which the immersion nozzle is provided with a pair of discharge holes of the molten metal on both sides in a mold long side direction of the mold, the electromagnetic brake device is installed on an outer side surface of each of a pair of long side mold plates in the mold, and is provided with an iron core including a pair of teeth provided so as to face the long side mold plate on both sides of the immersion nozzle in the mold long side direction, and coils wound around the respective teeth, the coils on one side in the mold long side direction of electromagnetic brake devices are connected in series in a first circuit, the coils on the other side in the mold long side direction of the electromagnetic brake devices are connected in series in a second circuit, and voltage and current applied to each of the first and second circuits are able to be independently controlled for each circuit. This continuous casting method includes drift detecting of detecting a drift of the discharge flow between the pair of discharge holes on the basis of the voltage applied to the coils in the first circuit and the voltage applied to the coils in the second circuit, and current controlling of controlling the current flowing through the first circuit and the current flowing through the second circuit on the basis of a detection result.

(5) In the continuous casting method according to (4) described above, it is possible to detect the drift on the basis of a difference between an electromotive force generated in the first circuit due to a change over time in a flow state of the discharge flow from the discharge hole on one side in the mold long side direction and an electromotive force generated in the second circuit due to a change over time in a flow state of the discharge flow from the discharge hole on the other side in the mold long side direction in the drift detecting, and control, in a case where the drift is detected, the current flowing through the first circuit and the current flowing through the second circuit such that the difference between the electromotive force generated in the first circuit and the electromotive force generated in the second circuit becomes small by increasing a current value of the circuit on a side on which the electromotive force is large or by decreasing a current value of the circuit on a side on which the electromotive force is small or combination thereof in the current controlling.

(6) In the continuous casting method according to (4) or (5) described above, the continuous casting may be performed while applying an electromagnetic force for generating a swirling flow in a horizontal plane to the molten metal in the mold by an electromagnetic stirring device installed above the electromagnetic brake device, and applying the electromagnetic force in a direction to brake the discharge flow to the discharge flow of the molten metal from the immersion nozzle into the mold by the electromagnetic brake device.

Effects of the Invention

As described above, according to the present invention, it is possible to further improve a quality of a slab in continuous casting.

EMBODIMENT OF THE INVENTION

Figure 1:
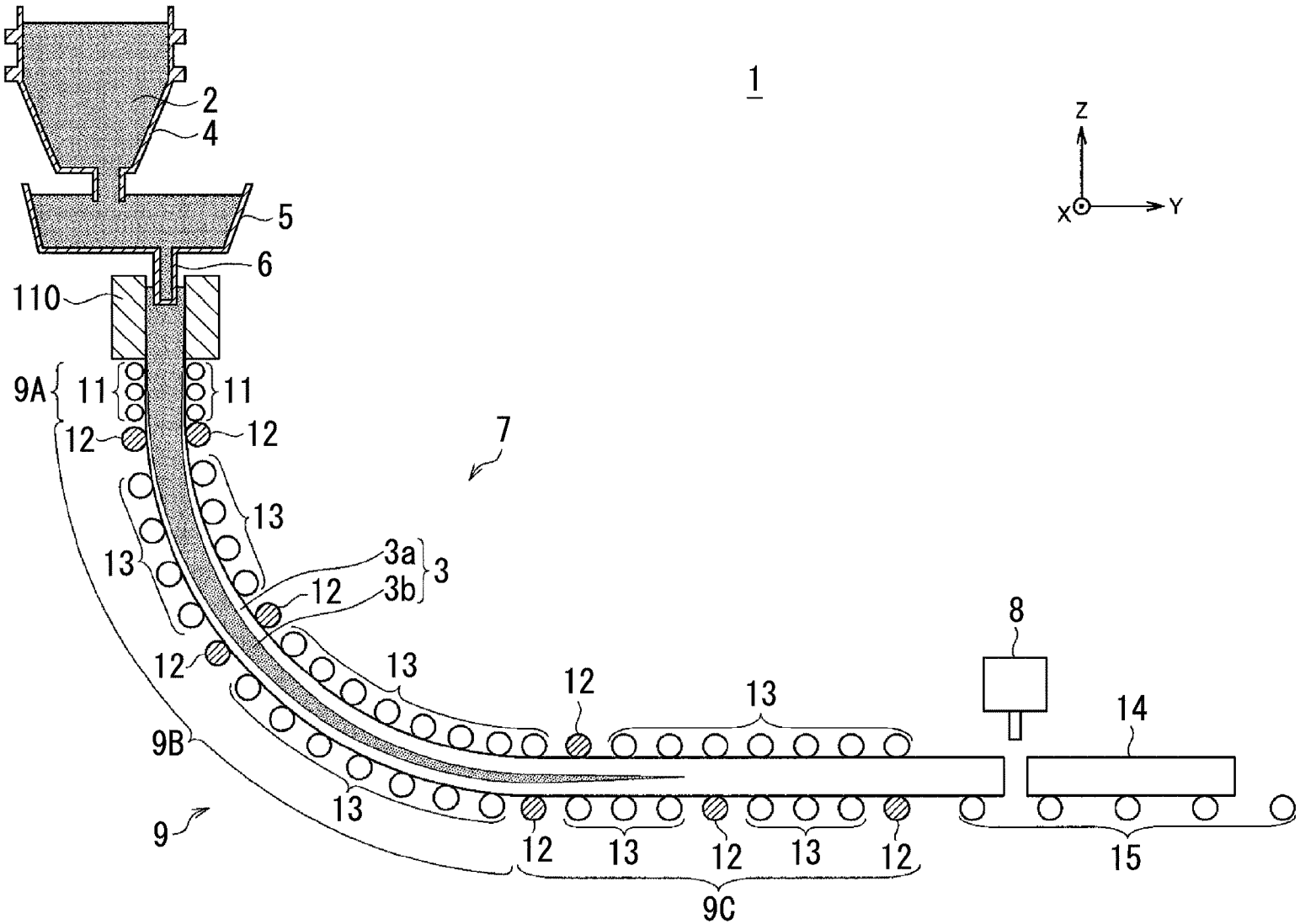
FIG. 1 is a side cross-sectional view schematically illustrating a configuration example of a continuous casting machine according to this embodiment.

The present inventors examined a reason that there is a case where a quality of a slab might be deteriorated in continuous casting using an electromagnetic force generating device provided with an electromagnetic brake device and an electromagnetic stirring device as exemplified in Patent Document 1 as compared with a case where such devices are used alone.

In the course of operation of the continuous casting, by adhesion of non-metallic inclusions contained in molten steel to a discharge hole of an immersion nozzle, an opening area of the discharge hole changes over time. Herein, the immersion nozzle is provided with a pair of discharge holes of molten metal on both sides in a mold long side direction of a mold, and the adhesion of the non-metallic inclusions to each discharge hole often unevenly progresses between the pair of discharge holes. Therefore, a difference in opening area might occur between the pair of discharge holes. In this case, a drift in which a flow volume and a flow speed of the discharge flow differ is generated between the pair of discharge holes. As a result, behavior of the discharge flow bounced up by the electromagnetic brake device becomes asymmetric on both the sides of the immersion nozzle in the mold long side direction. Therefore, it becomes difficult to appropriately control a flow of the molten metal in the mold, so that the quality of the slab might be deteriorated. Therefore, in a case of controlling the flow of the molten metal in the mold using the electromagnetic force generating device provided with at least the electromagnetic brake device as in the electromagnetic force generating device described above, it is possible to suppress the deterioration in quality of the slab caused by the adhesion of the non-metallic inclusions to the discharge holes of the immersion nozzle.

Especially, in a case of using the electromagnetic force generating device provided with the electromagnetic brake device and the electromagnetic stirring device exemplified in Patent Document 1, a problem of the deterioration in quality of the slab caused by the adhesion of the non-metallic inclusions to the discharge holes of the immersion nozzle is more remarkable. Specifically, the electromagnetic brake device and the electromagnetic stirring device do not always easily realize advantages of both the devices only by simply installing both the devices, and there also is a case where these devices affect to cancel out the advantages each other. Therefore, it was found that, in the continuous casting using both the electromagnetic brake device and the electromagnetic stirring device, the quality of the slab might be deteriorated to no small extent as compared with a case where these devices are used alone.

For example, as in Patent Document 1, in a configuration in which the electromagnetic stirring device is provided in an upper portion and the electromagnetic brake device is provided in a lower portion, the discharge flow from the discharge hole of the immersion nozzle is bounced up above the mold by the electromagnetic brake device to be electromagnetically stirred in the upper portion of the mold. Therefore, in a case where the behavior of the discharge flow bounced up by the electromagnetic brake device becomes asymmetric on both the sides in the mold long side direction due to generation of the drift, there is a risk that formation of a swirling flow by electromagnetic stirring in the upper portion of the mold is blocked. Therefore, in this case, not only an effect of improving a surface quality of the slab by the electromagnetic stirring cannot be suitably obtained, but also there is a risk that the quality of the slab is deteriorated.

Therefore, the present inventors achieved the technical idea of further improving the quality of the slab by detecting the drift of the discharge flow on the basis of voltage applied to a coil to control current in each circuit.

Regarding the present invention implemented on the basis of the above-described new knowledge, a preferred embodiment is described in detail with reference to the accompanying drawings. Meanwhile, in the present specification and the drawings, components having substantially the same functional configuration are assigned with the same reference sign, and the description thereof is not repeated.

<1. Configuration of Continuous Casting Machine>

First, a configuration of a continuous casting machine 1 and a continuous casting method according to one embodiment of the present invention are described with reference to FIG. 1. FIG. 1 is a side cross-sectional view schematically illustrating a configuration example of the continuous casting machine 1 according to this embodiment.

As illustrated in FIG. 1, the continuous casting machine 1 according to this embodiment is a device for continuously casting molten steel 2 by using a mold 110 for continuous casting to manufacture a slab 3. The continuous casting machine 1 is provided with the mold 110, a ladle 4, a tundish 5, an immersion nozzle 6, a secondary cooling device 7, and a slab cutter 8.

The ladle 4 is a movable container for conveying the molten steel 2 from outside to the tundish 5. The ladle 4 is arranged above the tundish 5, and the molten steel 2 in the ladle 4 is supplied to the tundish 5. The tundish 5 is arranged above the mold 110 to store the molten steel 2 and remove an inclusion in the molten steel 2. The immersion nozzle 6 extends downward from a lower end of the tundish 5 toward the mold 110 and a tip end thereof is immersed in the molten steel 2 in the mold 110. The immersion nozzle 6 continuously supplies the molten steel 2 from which the inclusion is removed in the tundish 5 into the mold 110.

The mold 110 has a quadrangular tubular shape corresponding to a width and a thickness of the slab 3, and is assembled, for example, so as to sandwich a pair of short side mold plates (corresponding to short side mold plates 112 illustrated in FIG. 4 and the like to be described later) by a pair of long side mold plates (corresponding to long side mold plates 111 illustrated in FIG. 2 and the like to be described later) from both sides. The long side mold plates and the short side mold plates (hereinafter, sometimes collectively referred to as mold plates) are, for example, water-cooled copper plates provided with a water channel through which cooling water flows. The mold 110 cools the molten steel 2 which comes into contact with such mold plates to manufacture the slab 3. As the slab 3 moves downward in the mold 110, solidification of an inner unsolidified portion 3*b* progresses, and a thickness of an outer solidified shell 3*a* gradually increases. The slab 3 including the solidified shell 3*a* and the unsolidified portion 3*b* is pulled out of a lower end of the mold 110.

Meanwhile, in the following description, an up-and-down direction (that is, a direction in which the slab 3 is pulled out of the mold 110) is also referred to as a Z-axis direction. The Z-axis direction is also referred to as a vertical direction. Two directions orthogonal to each other in a plane (horizontal plane) perpendicular to the Z-axis direction are also referred to as an X-axis direction and a Y-axis direction, respectively. The X-axis direction is defined as a direction parallel to a long side of the mold 110 in the horizontal plane (that is, a mold width direction or a mold long side direction), and the Y-axis direction is defined as a direction parallel to a short side of the mold 110 in the horizontal plane (that is, a mold thickness direction or a mold short side direction). A direction parallel to an X-Y plane is also referred to as a horizontal direction. In the following description, when expressing a size of each member, a length in the Z-axis direction of the member is sometimes also referred to as a height, and a length in the X-axis direction of the member or the Y-axis direction is sometimes also referred to as a width.

Herein, although it is not illustrated in FIG. 1 in order to avoid complication of the drawing, in this embodiment, an electromagnetic force generating device is installed on an outer side surface of the long side mold plate of the mold 110. Then, the continuous casting is performed while driving the electromagnetic force generating device. The electromagnetic force generating device is provided with an electromagnetic stirring device and an electromagnetic brake device. In this embodiment, the continuous casting is performed while driving the electromagnetic force generating device, so that it becomes possible to perform casting at a higher speed while securing a quality of the slab. A configuration of the electromagnetic force generating device is described later with reference to FIGS. 2 to 13.

The secondary cooling device 7 is provided in a secondary cooling zone 9 below the mold 110, and cools the slab 3 pulled out of the lower end of the mold 110 while supporting and conveying the same. The secondary cooling device 7 includes a plurality of pairs of rolls arranged on both sides in a thickness direction of the slab 3 (for example, support rolls 11, pinch rolls 12, and segment rolls 13), and a plurality of spray nozzles (not illustrated) which injects the cooling water to the slab 3.

The rolls provided on the secondary cooling device 7 are arranged in pairs on both the sides in the thickness direction of the slab 3, and serve as a supporting/conveying unit which conveys the slab 3 while supporting the same. By supporting the slab 3 from both the sides in the thickness direction by the rolls, breakout or bulging of the slab 3 during solidification in the secondary cooling zone 9 may be prevented.

The support rolls 11, the pinch rolls 12, and the segment rolls 13 which are the rolls form a conveyance path (path line) of the slab 3 in the secondary cooling zone 9. As illustrated in FIG. 1, this path line is vertical immediately below the mold 110, then curved into a curve to be finally horizontal. In the secondary cooling zone 9, portions in which the path line is vertical, curved, and horizontal are referred to as a vertical portion 9A, a curved portion 9B, and a horizontal portion 9C, respectively. The continuous casting machine 1 including such path line is referred to as a vertical bending continuous casting machine 1. Meanwhile, the present invention is not limited to the vertical bending continuous casting machine 1 as illustrated in FIG. 1, but may also be applied to various other types of continuous casting machines such as a curved type or a vertical type.

The support rolls 11 are non-driven rolls provided in the vertical portion 9A immediately below the mold 110, and support the slab 3 immediately after being pulled out of the mold 110. Immediately after being pulled out of the mold 110, the slab 3 is in a state in which the solidified shell 3*a* is thin, so that this needs to be supported at a relatively short interval (roll pitch) in order to prevent breakout and bulging. Therefore, as the support roll 11, a roll having a small diameter capable of shortening the roll pitch is desirably used. In the example illustrated in FIG. 1, three pairs of support rolls 11 each having a small diameter are provided on both the sides of the slab 3 in the vertical portion 9A at a relatively narrow roll pitch.

The pinch rolls 12 are driven rolls rotated by a driving unit such as a motor, and have a function of pulling the slab 3 out of the mold 110. The pinch rolls 12 are arranged in appropriate positions in the vertical portion 9A, the curved portion 9B, and the horizontal portion 9C. The slab 3 is pulled out of the mold 110 by a force transmitted from the pinch rolls 12 and is conveyed along the path line. Meanwhile, the arrangement of the pinch rolls 12 is not limited to the example illustrated in FIG. 1, and arranging positions thereof may be set arbitrarily.

The segment rolls 13 (also referred to as guide rolls) are non-driven rolls provided in the curved portion 9B and the horizontal portion 9C, and support and guide the slab 3 along the path line. The segment rolls 13 may be arranged with different roll diameters and roll pitches depending on the position on the path line, and depending on a surface out of a fixed surface (F surface, a lower left surface in FIG. 1) or a loose surface (L surface, an upper right surface in FIG. 1) of the slab 3 on which this is provided.

The slab cutter 8 is arranged at a terminal end of the horizontal portion 9C of the path line and cuts the slab 3 conveyed along the path line into a predetermined length. A cut slab 14 in a thick plate shape is conveyed to equipment of a next step by table rolls 15.

An entire configuration of the continuous casting machine 1 according to this embodiment is described above with reference to FIG. 1. Meanwhile, in this embodiment, it is sufficient that the electromagnetic force generating device having a configuration to be described later is installed for the mold 110 and the continuous casting is performed by using the electromagnetic force generating device; the configuration other than the electromagnetic force generating device in the continuous casting machine 1 may be similar to that of a general conventional continuous casting machine. Therefore, the configuration of the continuous casting machine 1 is not limited to that illustrated in the drawing, and the continuous casting machine 1 having any configuration may be used.

<2. Configuration of Electromagnetic Force Generating Device>

Next, with reference to FIGS. 2 to 13, the configuration of the electromagnetic force generating device installed for the mold 110 described above is described in detail. Meanwhile, although an example in which an electromagnetic force generating device 170 is provided with an electromagnetic stirring device 150 and an electromagnetic brake device 160 is described in the present specification, the present invention is not limited to such an example. For example, the electromagnetic stirring device 150 may be omitted from the configuration of the electromagnetic force generating device 170.

Figure 2:
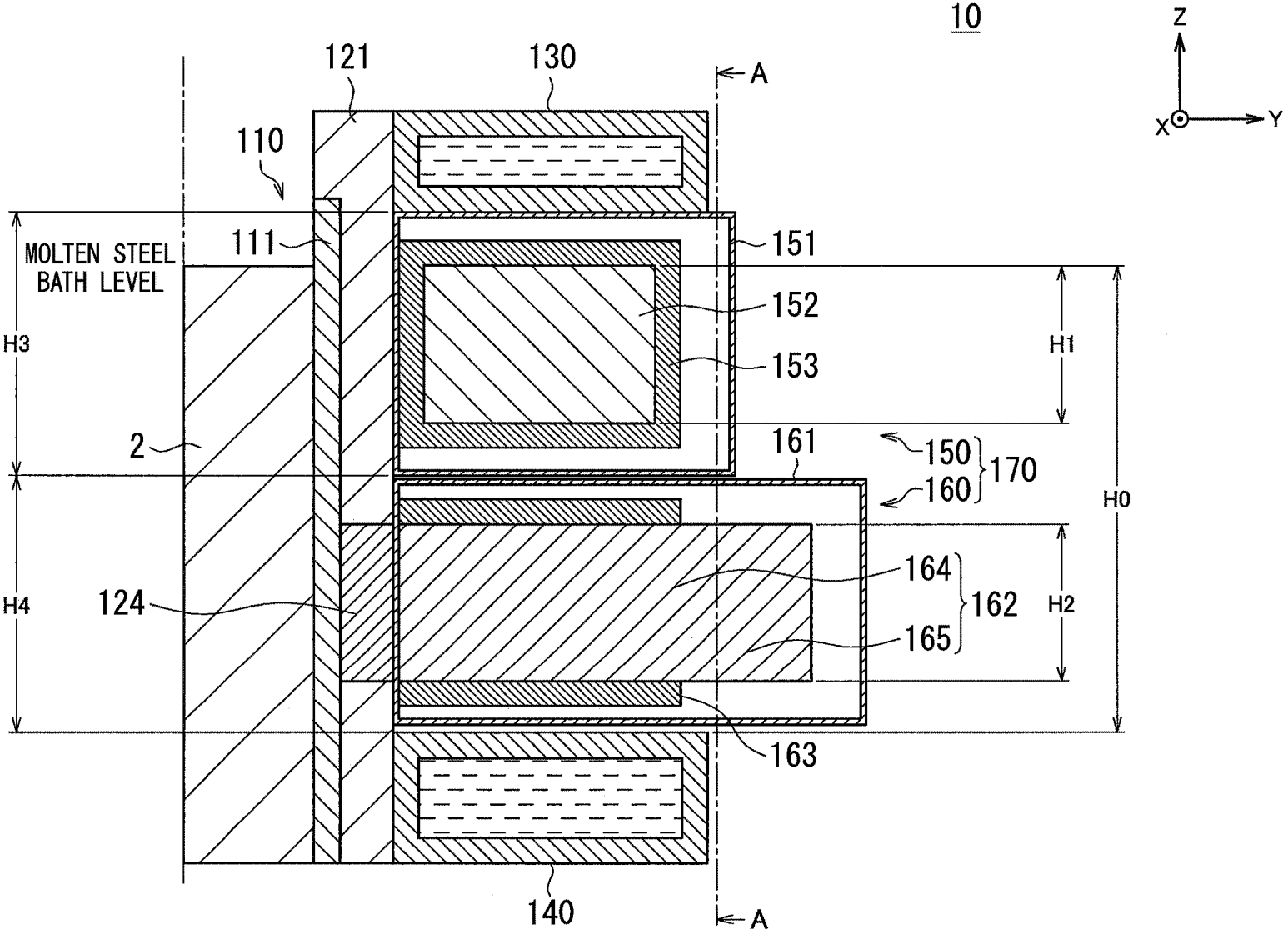
FIG. 2 is a cross-sectional view in a Y-Z plane of mold equipment according to this embodiment.
Figure 3:
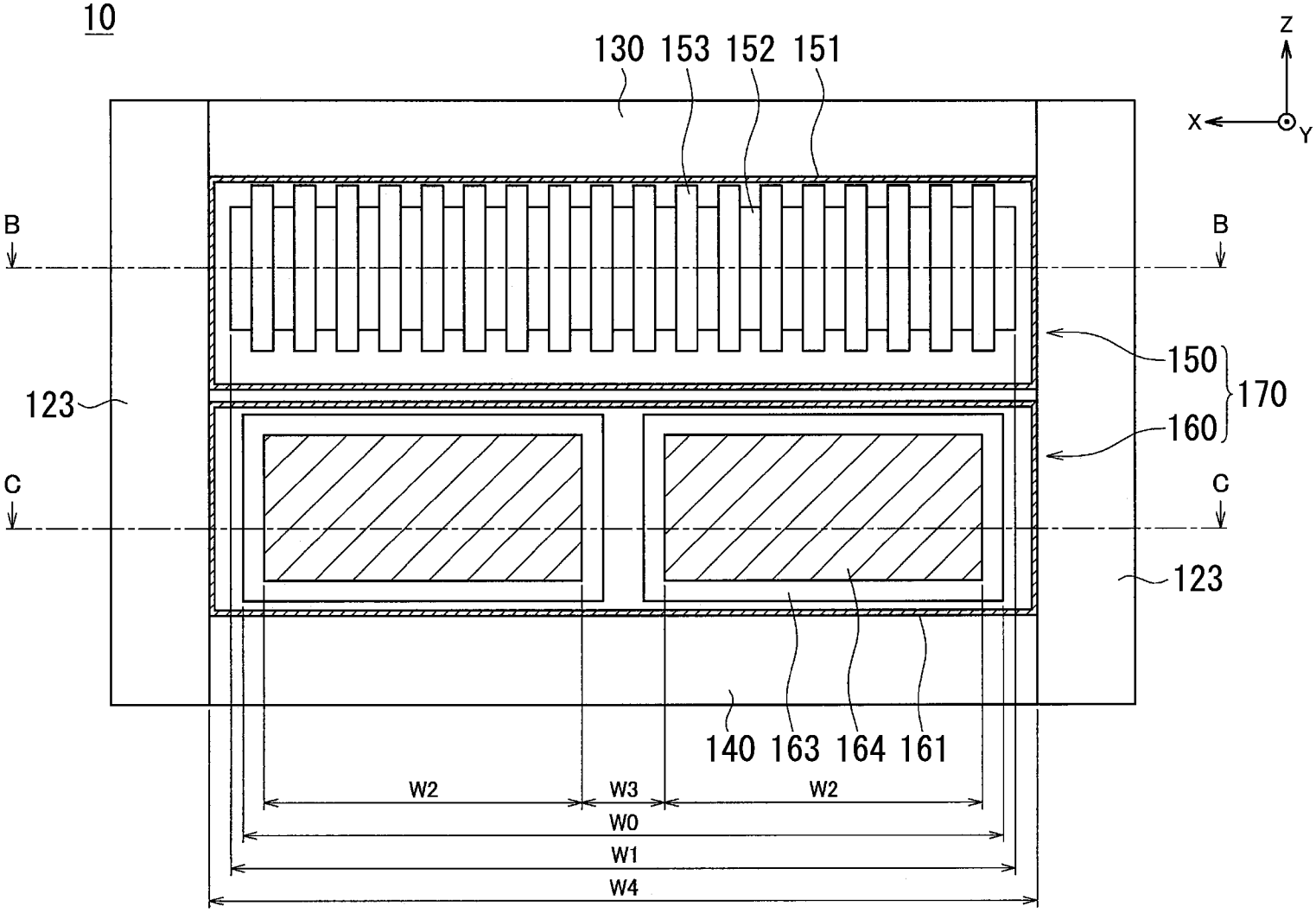
FIG. 3 is a cross-sectional view of the mold equipment taken along line A-A in FIG. 2.
Figure 4:
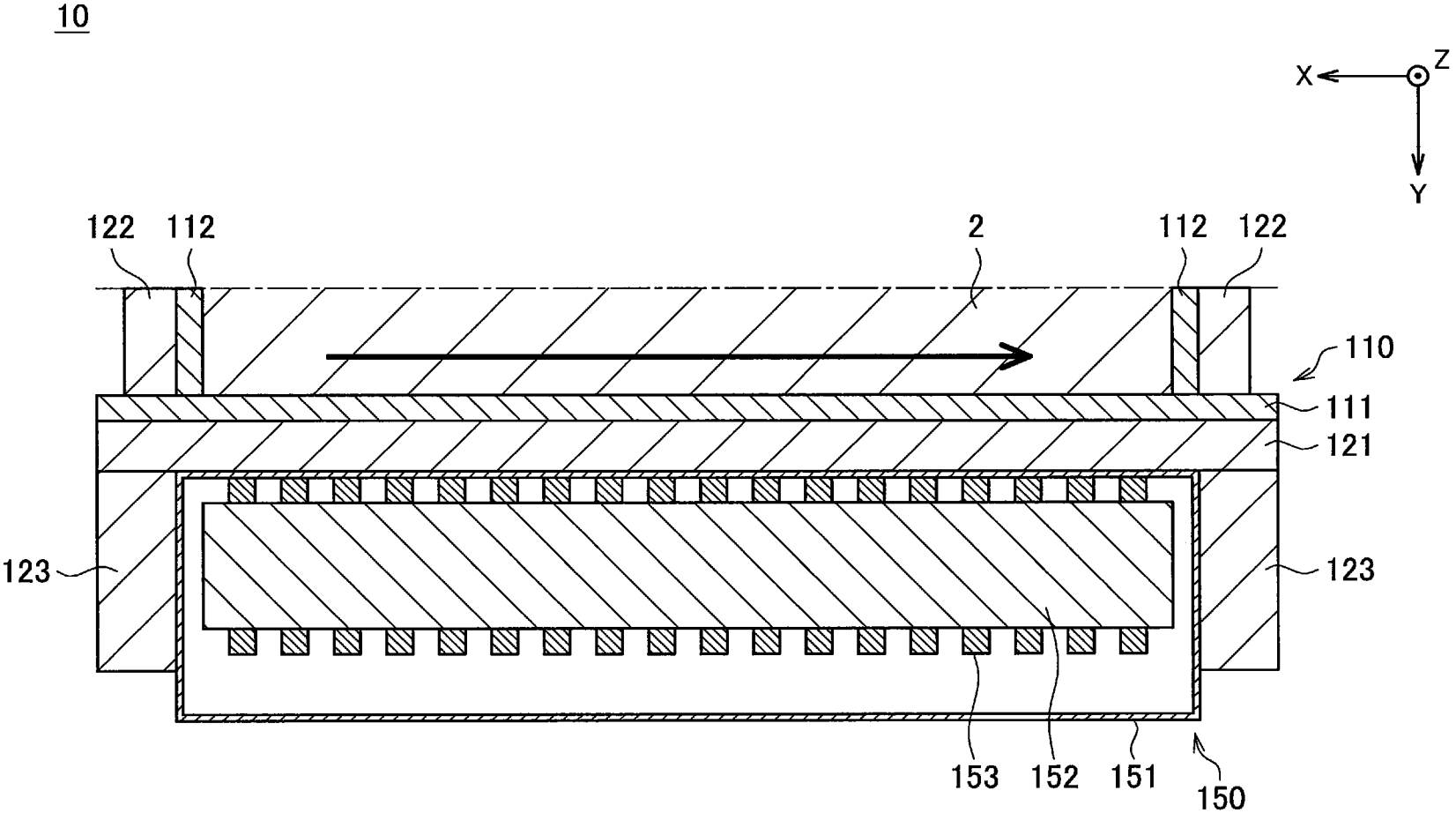
FIG. 4 is a cross-sectional view of the mold equipment taken along line B-B in FIG. 3.
Figure 5:
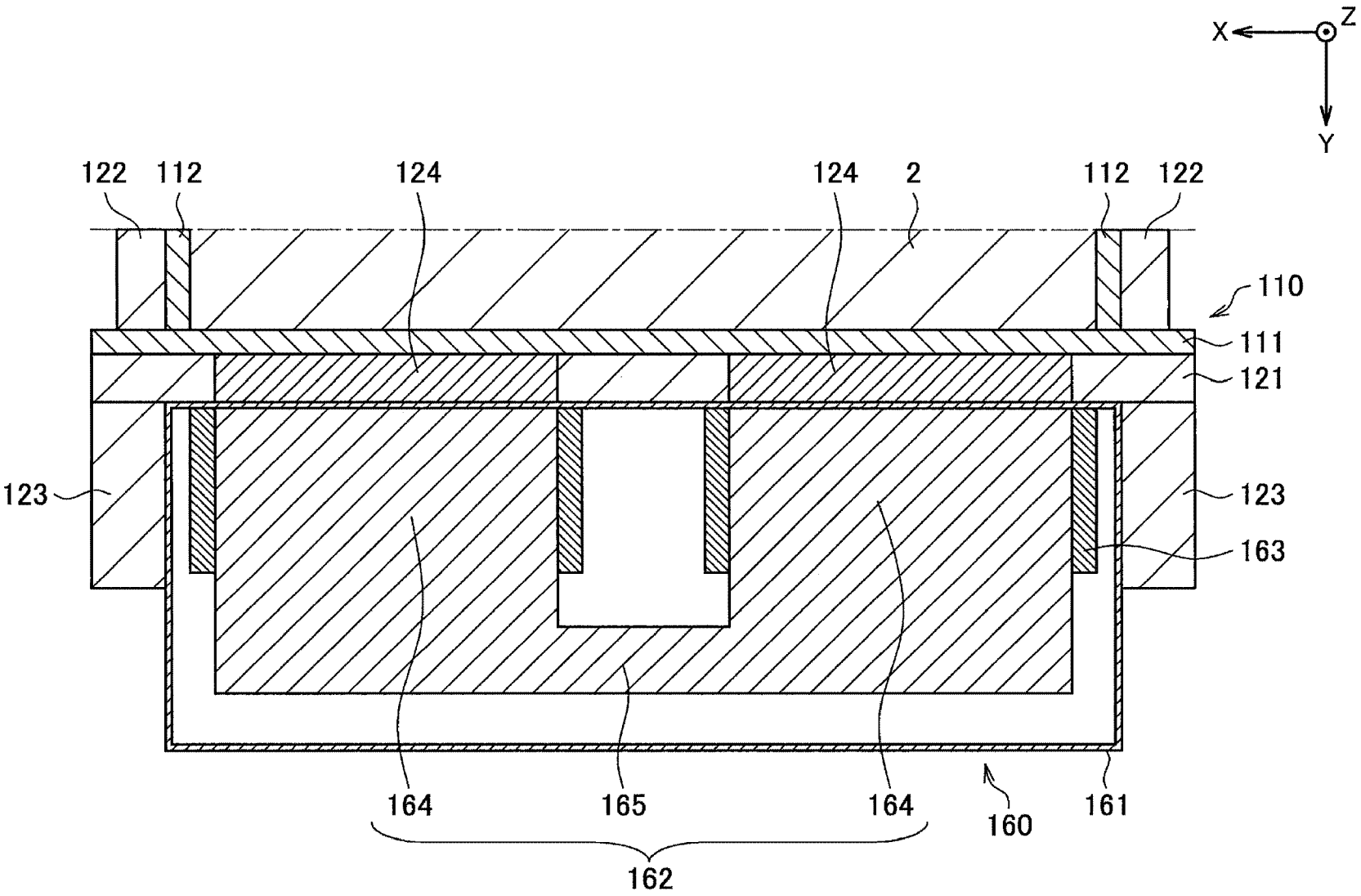
FIG. 5 is a cross-sectional view of the mold equipment taken along line C-C in FIG. 3.

FIGS. 2 to 5 are views illustrating a configuration example of mold equipment according to this embodiment. FIG. 2 is a cross-sectional view in a Y-Z plane of the mold equipment 10 according to this embodiment. FIG. 3 is a cross-sectional view of the mold equipment 10 taken along line A-A in FIG. 2. FIG. 4 is a cross-sectional view of the mold equipment 10 taken along line B-B in FIG. 3. FIG. 5 is a cross-sectional view of the mold equipment 10 taken along line C-C in FIG. 3. Meanwhile, since the mold equipment 10 has a configuration symmetrical with respect to the center of the mold 110 in the Y-axis direction, only a portion corresponding to one long side mold plate 111 is illustrated in FIGS. 2, 4, and 5. In FIGS. 2, 4, and 5, the molten steel 2 in the mold 110 is also illustrated in order to facilitate understanding.

With reference to FIG. 2 to FIG. 5, the mold equipment 10 according to this embodiment includes two water boxes 130 and 140 and the electromagnetic force generating device 170 installed on the outer side surface of the long side mold plate 111 of the mold 110 via a backup plate 121.

As described above, the mold 110 is assemble such that a pair of short side mold plates 112 are sandwiched by a pair of long side mold plates 111 from both sides. The mold plates 111 and 112 are made of copper plates. However, this embodiment is not limited to such an example, and the mold plates 111 and 112 may be formed of various materials generally used as the mold of the continuous casting machine.

Herein, this embodiment is targeted to continuous casting of a steel slab, and a slab size is about 800 to 2,300 mm in width (that is, the length in the X-axis direction) and about 200 to 300 mm in thickness (that is, the length in the Y-axis direction). That is, each of the mold plates 111 and 112 has a size corresponding to the slab size. That is, the long side mold plate 111 has the width in the X-axis direction at least longer than the width of 800 to 2,300 mm of the slab 3, and the short side mold plate 112 has the width in the Y-axis direction substantially the same as the thickness of 200 to 300 mm of the slab 3.

As described later in detail, in this embodiment, in order to more effectively obtain an effect of improving the quality of the slab 3 by the electromagnetic force generating device 170, the mold 110 is formed to have the length in the Z-axis direction as long as possible. It is generally known that there is a case where, when solidification of the molten steel 2 progresses in the mold 110, the slab 3 is separated from an inner wall of the mold 110 due to solidification contraction, so that the slab 3 is not cooled sufficiently. Therefore, the length of the mold 110 in the Z direction is limited to about 1,000 mm at the longest from a molten steel bath level. In this embodiment, in consideration of such circumstances, each of the mold plates 111 and 112 is formed so that the length from the molten steel bath level to a lower end of each of the mold plates 111 and 112 is about 1,000 mm.

The backup plates 121 and 122 are made of, for example, stainless steel, and are provided so as to cover the outer side surfaces of the mold plates 111 and 112, respectively, in order to reinforce the mold plates 111 and 112 of the mold 110. Hereinafter, for the sake of distinction, the backup plate 121 provided on the outer side surface of the long side mold plate 111 is also referred to as a long side backup plate 121, and the backup plate 122 provided on the outer side surface of the short side mold plate 112 is also referred to as a short side backup plate 122.

Since the electromagnetic force generating device 170 applies an electromagnetic force to the molten steel 2 in the mold 110 via the long side backup plate 121, at least the long side backup plate 121 may be made of a non-magnetic material (for example, non-magnetic stainless steel and the like). However, magnetic soft iron 124 is embedded in portions facing teeth 164 of an iron core (core) 162 (hereinafter, also referred to as an electromagnetic brake core 162) of the electromagnetic brake device 160 to be described later of the long side backup plate 121 in order to secure a magnetic flux density of the electromagnetic brake device 160.

On the long side backup plate 121, a pair of backup plates 123 extending in a direction perpendicular to the long side backup plate 121 (that is, the Y-axis direction) is further provided. As illustrated in FIGS. 3 to 5, the electromagnetic force generating device 170 is installed between the pair of backup plates 123. In this manner, the backup plates 123 may define a width (that is, the length in the X-axis direction) and an installation position in the X-axis direction of the electromagnetic force generating device 170. In other words, an attaching position of the backup plate 123 is determined so that the electromagnetic force generating device 170 may apply the electromagnetic force to a desired range of the molten steel 2 in the mold 110. Hereinafter, for the sake of distinction, the backup plate 123 is also referred to as a width-direction backup plate 123. Similarly to the backup plates 121 and 122, the width-direction backup plate 123 is also made of stainless steel, for example.

The water boxes 130 and 140 store the cooling water for cooling the mold 110. In this embodiment, as illustrated in the drawings, one water box 130 is installed in an area of a predetermined distance from an upper end of the long side mold plate 111, and the other water box 140 is installed in an area of a predetermined distance from a lower end of the long side mold plate 111. In this manner, by providing the water boxes 130 and 140 in the upper and lower portions of the mold 110, respectively, it becomes possible to secure a space for installing the electromagnetic force generating device 170 between the water boxes 130 and 140. Hereinafter, for the sake of distinction, the water box 130 provided in the upper portion of the long side mold plate 111 is also referred to as an upper water box 130, and the water box 140 provided in the lower portion of the long side mold plate 111 is also referred to as a lower water box 140.

A water channel (not illustrated) through which the cooling water passes is formed inside the long side mold plate 111 or between the long side mold plate 111 and the long side backup plate 121. The water channel extends to the water boxes 130 and 140. By a pump not illustrated, the cooling water flows from one of the water boxes 130 and 140 toward the other of the water boxes 130 and 140 (for example, from the lower water box 140 toward the upper water box 130) via the water channel. Thereby, the long side mold plate 111 is cooled, and the molten steel 2 inside the mold 110 is cooled via the long side mold plate 111. Meanwhile, although not illustrated, a water box and a water channel are similarly provided for the short side mold plate 112, and the short side mold plate 112 is cooled when the cooling water flows.

The electromagnetic force generating device 170 is provided with the electromagnetic stirring device 150 and the electromagnetic brake device 160. As illustrated, the electromagnetic stirring device 150 and the electromagnetic brake device 160 are installed in the space between the water boxes 130 and 140. In the space, the electromagnetic stirring device 150 is installed above and the electromagnetic brake device 160 is installed below. Meanwhile, as for heights of the electromagnetic stirring device 150 and the electromagnetic brake device 160, and installation positions of the electromagnetic stirring device 150 and the electromagnetic brake device 160 in the Z-axis direction are described in detail in following [2-2. Detail of installation position of electromagnetic force generating device].

(Electromagnetic Stirring Device)

The electromagnetic stirring device 150 applies a moving magnetic field to the molten steel 2 in the mold 110, thereby applying the electromagnetic force to the molten steel 2. The electromagnetic stirring device 150 is driven to apply the electromagnetic force in a width direction (that is, the X-axis direction) of the long side mold plate 111 on which this is installed to the molten steel 2. In FIG. 4, a direction of the electromagnetic force applied to the molten steel 2 by the electromagnetic stirring device 150 is schematically indicated by a thick arrow. Herein, the electromagnetic stirring device 150 provided on the long side mold plate 111 not illustrated (that is, the long side mold plate 111 facing the illustrated long side mold plate 111) is driven to apply an electromagnetic force in a direction opposite to the indicated direction in the width direction of the long side mold plate 111 on which this is installed. In this manner, a pair of electromagnetic stirring devices 150 is driven to generate a swirling flow in the horizontal plane. According to the electromagnetic stirring device 150, by generating such swirling flow, the molten steel 2 at a solidified shell interface flows, and a cleaning effect of suppressing capture of bubbles and inclusions in the solidified shell 3*a* is obtained, so that a surface quality of the slab 3 may be improved.

A detailed configuration of the electromagnetic stirring device 150 is described. The electromagnetic stirring device 150 is formed of a case 151, an iron core (core) 152 (hereinafter also referred to as an electromagnetic stirring core 152) stored in the case 151, and a plurality of coils 153 obtained by winding a conductive wire around the electromagnetic stirring core 152.

The case 151 is a hollow member having a substantially rectangular parallelepiped shape. A size of the case 151 may be appropriately determined such that the electromagnetic stirring device 150 may apply the electromagnetic force to a desired range of the molten steel 2, that is, the coils 153 provided inside may be arranged in appropriate positions with respect to the molten steel 2. For example, a width W4 in the X-axis direction of the case 151, that is, the width W4 in the X-axis direction of the electromagnetic stirring device 150 is determined so as to be wider than a width of the slab 3 such that the electromagnetic force may be applied to the molten steel 2 in the mold 110 in any position in the X-axis direction. For example, W4 is about 1,800 mm to 2,500 mm Since the electromagnetic force is applied to the molten steel 2 from the coils 153 through a side wall of the case 151 in the electromagnetic stirring device 150, a non-magnetic member of which strength may be secured such as non-magnetic stainless steel or fiber reinforced plastics (FRP), for example, is used as a material of the case 151.

The electromagnetic stirring core 152 is a solid member having a substantially rectangular parallelepiped shape, and is installed in the case 151 such that a longitudinal direction of which is substantially parallel to the width direction (that is, the X-axis direction) of the long side mold plate 111. The electromagnetic stirring core 152 is formed, for example, by stacking electrical steel sheets.

Each of the coils 153 is formed by winding the conductive wire around the electromagnetic stirring core 152 such that the X-axis direction is a winding-axis direction (that is, the coils 153 are formed to magnetize the electromagnetic stirring core 152 in the X-axis direction). As the conductive wire, for example, a copper wire having a cross-section of 10 mm×10 mm and including a cooling water channel having a diameter of about 5 mm inside is used. When current is applied, the conductive wire is cooled by using the cooling water channel. A surface layer of the conductive wire is insulated with an insulating paper and the like, thus, the conductive wire may be wound in layers. For example, one coil 153 is formed by winding the conductive wire in about two to four layers. The coils 153 having a similar configuration are arranged in parallel at a predetermined interval in the X-axis direction.

A power supply device not illustrated is connected to each of the plurality of coils 153. By the power supply device, alternating current is applied to the plurality of coils 153 so that a phase of the current is appropriately shifted in arrangement order of the plurality of coils 153, so that the electromagnetic force to generate the swirling flow may be applied to the molten steel 2. Drive of the power supply device may be appropriately controlled by a control device (not illustrated) including a processor and the like operating according to a predetermined program. The control device appropriately controls an amount of current applied to each of the coils 153, the phase of the alternating current applied to each of the coils 153 and the like, and strength of the electromagnetic force applied to the molten steel 2 may be controlled.

A width W1 in the X-axis direction of the electromagnetic stirring core 152 may be appropriately determined such that the electromagnetic stirring device 150 may apply the electromagnetic force in the desired range of the molten steel 2, that is, the coils 153 may be arranged in appropriate positions with respect to the molten steel 2. For example, W1 is about 1,800 mm (Electromagnetic Brake Device)

Figure 6:
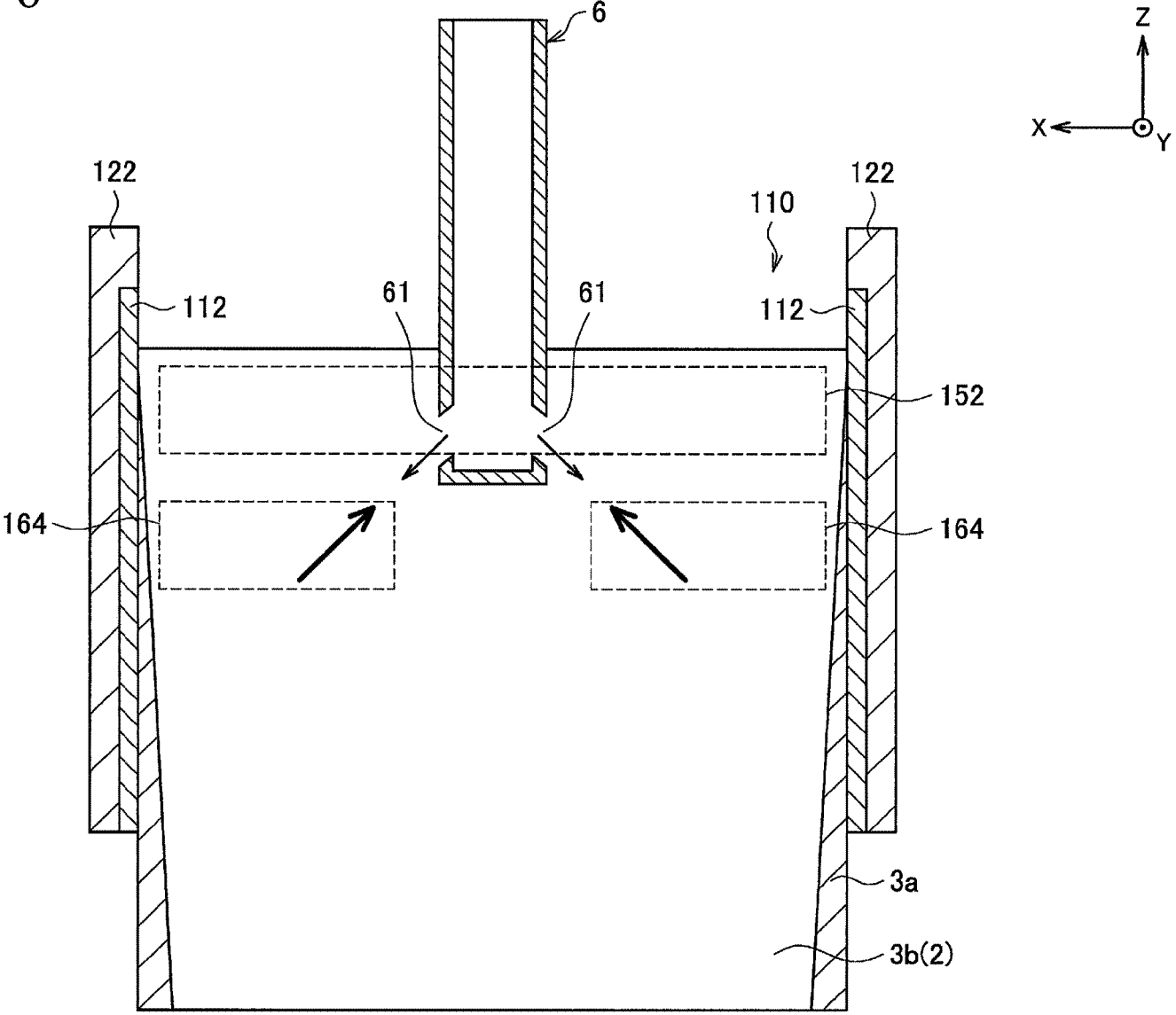
FIG. 6 is a view for illustrating a direction of an electromagnetic force applied to a discharge flow of molten steel by an electromagnetic brake device.

The electromagnetic brake device 160 applies a static magnetic field to the molten steel 2 in the mold 110, thereby applying the electromagnetic force to the molten steel 2. Herein, FIG. 6 is a view for illustrating a direction of the electromagnetic force applied to the discharge flow of the molten steel 2 by the electromagnetic brake device 160. FIG. 6 schematically illustrates a cross-section in the X-Z plane of the configuration in the vicinity of the mold 110. In FIG. 6, positions of the electromagnetic stirring core 152 and the teeth 164 of the electromagnetic brake core 162 to be described later are schematically indicated by broken lines.

As illustrated in FIG. 6, the immersion nozzle 6 is provided with a pair of discharge holes 61 of the molten steel 2 on both the sides in the mold long side direction (that is, the X-axis direction). The discharge hole 61 faces the short side mold plate 112 and is provided so as to be inclined downward from an inner peripheral surface side to an outer peripheral surface side of the immersion nozzle 6 in this direction. The electromagnetic brake device 160 is driven so as to apply to the electromagnetic force in a direction to brake the flow (discharge flow) of the molten steel 2 from the discharge hole 61 of the immersion nozzle 6 to the discharge flow. In FIG. 6, directions of the discharge flows are schematically indicated by thin arrows, and the directions of the electromagnetic force applied to the molten steel 2 by the electromagnetic brake device 160 are schematically indicated by bold arrows. According to the electromagnetic brake device 160, a downward flow is suppressed by generating such electromagnetic force in the direction to brake the discharge flow, and an effect of promoting floating separation of the bubbles and inclusions is obtained, so that an inner quality of the slab 3 may be improved.

A detailed configuration of the electromagnetic brake device 160 is described. The electromagnetic brake device 160 is formed of a case 161, an electromagnetic brake core 162 stored in the case 161, and a plurality of coils 163 obtained by winding a conductive wire around the electromagnetic brake core 162.

The case 161 is a hollow member having a substantially rectangular parallelepiped shape. A size of the case 161 may be appropriately determined such that the electromagnetic brake device 160 may apply the electromagnetic force to the desired range of the molten steel 2, that is, the coils 163 provided inside may be arranged in appropriate positions with respect to the molten steel 2. For example, a width W4 in the X-axis direction of the case 161, that is, the width W4 in the X-axis direction of the electromagnetic brake device 160 is determined so as to be wider than the width of the slab 3 such that the electromagnetic force may be applied to the molten steel 2 in the mold 110 in a desired position in the X-axis direction. In the illustrated example, the width W4 of the case 161 is substantially similar to the width W4 of the case 151. However, this embodiment is not limited to such example, and the width of the electromagnetic stirring device 150 and the width of the electromagnetic brake device 160 may be different from each other.

Since the electromagnetic force is applied to the molten steel 2 from the coils 163 through a side wall of the case 161 in the electromagnetic brake device 160, the case 161 is formed of a non-magnetic material of which strength may be secured such as non-magnetic stainless steel or FRP, for example as is the case with the case 151.

The electromagnetic brake core 162 corresponds to an example of the iron core of the electromagnetic brake device according to the present invention. The electromagnetic brake core 162 is formed of a pair of teeth 164 being solid members having substantially rectangular parallelepiped shapes around which the coils 163 are wound, and a connecting unit 165 being a solid member similarly having a substantially rectangular parallelepiped shape which connects the pair of teeth 164. The electromagnetic brake core 162 is configured such that the pair of teeth 164 is provided so as to project from the connecting unit 165 in the Y-axis direction and toward the long side mold plate 111. The electromagnetic brake core 162 may be formed by using, for example, soft iron having high magnetic characteristics, or may be formed by stacking electrical steel sheets.

Specifically, a pair of teeth 164 is provided on both the sides of the immersion nozzle 6 in the mold long side direction so as to face the long side mold plate 111, and such electromagnetic brake device 160 is installed on an outer side surface of each of a pair of long side mold plates 111 of the mold 110. Installation positions of the teeth 164 may be positions in which the electromagnetic force is wanted to be applied to the molten steel 2, that is, positions in which the discharge flows from the pair of discharge holes 61 of the immersion nozzle 6 pass through an area where the magnetic field is applied by the coils 163 (refer also to FIG. 6).

Each of the coils 163 is formed by winding a conductive wire around the tooth 164 of the electromagnetic brake core 162 such that the Y-axis direction is a winding-axis direction (that is, the coils 163 are formed to magnetize the tooth 164 of the electromagnetic brake core 162 in the Y-axis direction). A structure of the coil 163 is similar to that of the coil 153 of the electromagnetic stirring device 150 described above.

Figure 7:
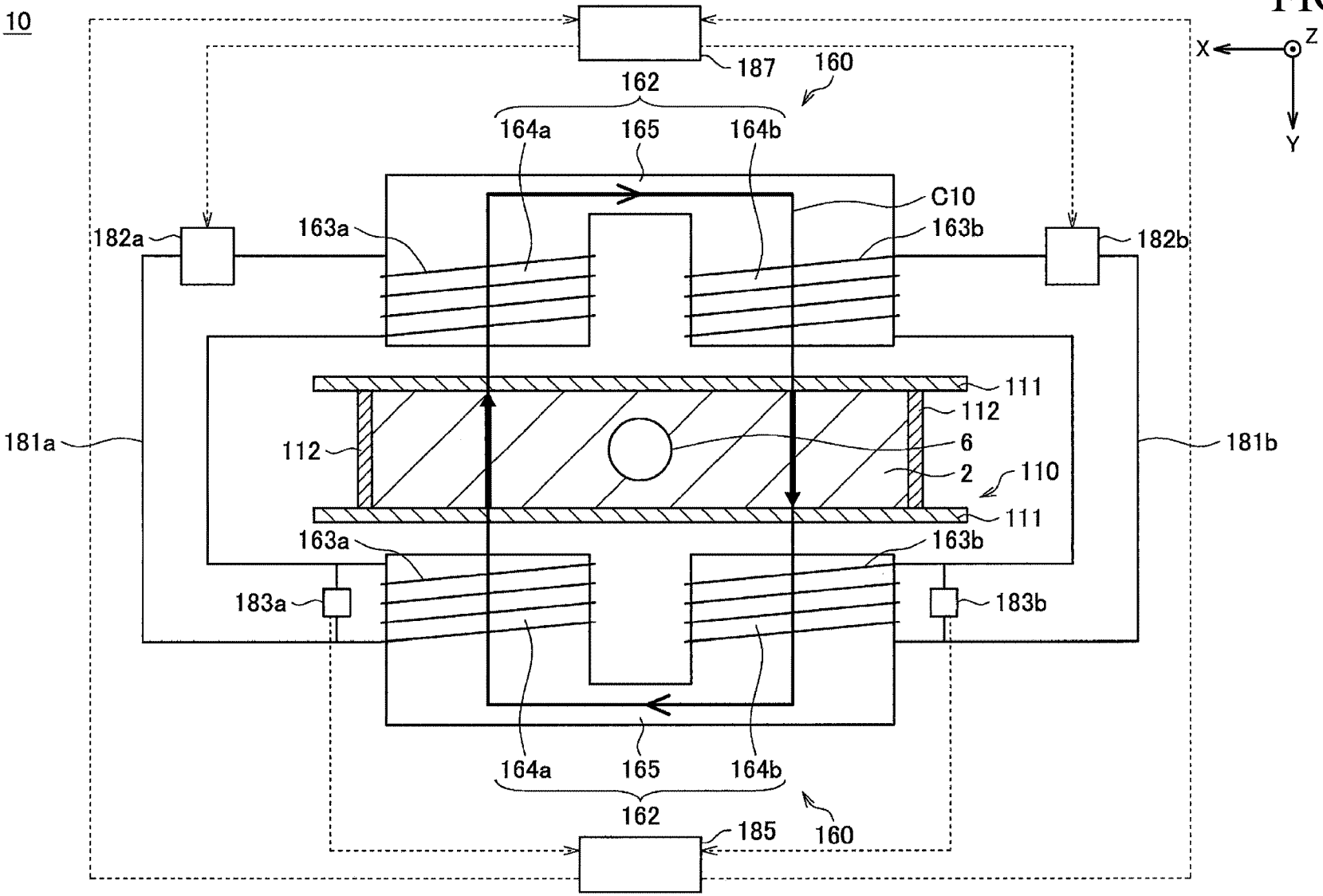
FIG. 7 is a view for illustrating an electrical connection relationship of each coil in the electromagnetic brake device.

A power supply device is connected to each of the coils 163. By applying direct current to each coil 163 by the power supply device, an electromagnetic force to weaken a power of the discharge flow may be applied to the molten steel 2. Herein, FIG. 7 is a view for illustrating an electrical connection relationship of each coil 163 in the electromagnetic brake device 160. In FIG. 7, directions of magnetic fluxes generated in the mold 110 in a case where the direct current is applied to each coil 163 in the electromagnetic brake device 160 are schematically indicated by bold arrows. Meanwhile, the case 161 is not illustrated in FIG. 7.

As illustrated in FIG. 7, the mold equipment 10 is provided with a first circuit 181*a* and a second circuit 181*b* as an electric circuit which connects the power supply device to each coil 163.

In the first circuit 181*a*, the coils 163*a* on one side in the mold long side direction of a pair of electromagnetic brake devices 160 are connected in series to each other. In the first circuit 181*a*, a power supply device 182*a* is connected in series to a pair of coils 163*a*, and current is applied to the pair of coils 163*a* by the power supply device 182*a*. In contrast, in the second circuit 181*b*, the coils 163*b* on the other side in the mold long side direction of the pair of electromagnetic brake devices 160 are connected in series to each other. In the second circuit 181*b*, a power supply device 182*b* is connected in series to the pair of coils 163*b*, and current is applied to the pair of coils 163*b* by the power supply device 182*b*.

In the first circuit 181*a*, when direct current is applied to the pair of coils 163*a*, the teeth 164*a* on one side in the mold long side direction of a pair of electromagnetic brake cores 162 are magnetized so as to serve as a pair of magnetic poles. Therefore, a magnetic field generated by the pair of coils 163*a* generates the magnetic flux in the mold short side direction on one side of the immersion nozzle 6 in the mold long side direction in the mold 110. In contrast, in the second circuit 181*b*, when direct current is applied to the pair of coils 163*b*, the teeth 164*b* on the other side in the mold long side direction of the pair of electromagnetic brake cores 162 are magnetized so as to serve as a pair of magnetic poles. Therefore, a magnetic field generated by the pair of coils 163*b* generates the magnetic flux in the mold short side direction on the other side of the immersion nozzle 6 in the mold long side direction in the mold 110. Herein, directions of the current flowing through the first circuit 181*a* and the second circuit 181*b* are such that the magnetic fluxes generated on both the sides of the immersion nozzle 6 in the mold long side direction in the mold 110 are opposite to each other.

The mold equipment 10 is further provided with voltage sensors 183*a* and 183*b*, an amplifier 185, and a control device 187.

The voltage sensors 183*a* and 183*b* detect the voltage applied to the coil 163 in the first circuit 181*a* and the second circuit 181*b*, respectively, and output a detected value to the amplifier 185. For example, the voltage sensor 183*a* is connected in parallel to one coil 163*a* in the first circuit 181*a*. The voltage sensor 183*b* is connected in parallel to one coil 163*b* in the second circuit 181*b*.

The amplifier 185 amplifies the detected values by the voltage sensors 183*a* and 183*b* and outputs the same to the control device 187. As a result, even in a case where a difference in detected value between the voltage sensors 183*a* and 183*b* is relatively small, it is possible to appropriately determine whether there is a difference between voltages applied to the coils 163 in the first circuit 181*a* and the second circuit 181*b*. Meanwhile, such determination is used by the control device 187 to detect the drift of the discharge flow between the pair of discharge holes 61 of the immersion nozzle 6 as described later.

The control device 187 controls a power supply to the electromagnetic brake device 160. For example, the control device 187 is formed of a central processing unit (CPU) being an arithmetic processing device, a read only memory (ROM) which stores programs and arithmetic parameters used by the CPU, a random access memory (RAM) which temporarily stores parameters and the like changing appropriately during execution of the CPU, and a data storage device such as a hard disk drive (HDD) which stores data and the like.

Specifically, the control device 187 may control drive of the power supply device 182*a* and the power supply device 182*b*, thereby independently controlling voltage and current applied to each of the first circuit 181*a* and the second circuit 181*b* for each circuit. More specifically, the control device 187 controls a current value of the current applied to the coil 163 in each of the first circuit 181*a* and the second circuit 181*b*. As a result, the magnetic flux generated in the mold 110 is controlled, and the electromagnetic force applied to the molten steel 2 is controlled.

The control device 187 detects the drift of the discharge flow between the pair of discharge holes 61 of the immersion nozzle 6 on the basis of the voltage applied to the coil 163 in each of the first circuit 181*a* and the second circuit 181*b*. Specifically, the control device 187 detects the drift of the discharge flow by using information output from the amplifier 185.

Meanwhile, the control by the control device 187 is described in detail in following [2-1. Detail of control performed by control device].

A width W0 in the X-axis direction of the electromagnetic brake core 162, a width W2 in the X-axis direction of the tooth 164, and a distance W3 between the teeth 164 in the X-axis direction may be appropriately determined such that the electromagnetic stirring device 150 may apply the electromagnetic force in the desired range of the molten steel 2, that is, the coils 163 may be arranged in appropriate positions with respect to the molten steel 2. For example, W0 is about 1,600 mm, W2 is about 500 mm, and W3 is about 350 mm.

Herein, for example, as in the technology disclosed in Patent Document 1 described above, there is the electromagnetic brake device including a single magnetic pole which generates a uniform magnetic field in the mold width direction. In the electromagnetic brake device having such a configuration, since a uniform electromagnetic force is applied in the width direction, there is a disadvantage that the range to which the electromagnetic force is applied cannot be controlled in detail and appropriate casting conditions are limited.

In contrast, in this embodiment, as described above, the electromagnetic brake device 160 is configured to include two teeth 164, that is, to include two magnetic poles. According to such configuration, for example, when driving the electromagnetic brake device 160, the two magnetic poles serve as an N pole and an S pole, respectively, and it is possible to control the application of the current to the coil 163 by the above-described control device such that the magnetic flux density is substantially zero in the area in the vicinity of substantial the center in the width direction (that is, the X-axis direction) of the mold 110. The area where the magnetic flux density is substantially zero is the area where the electromagnetic force is substantially not applied to the molten steel 2, the area released from the braking force by the electromagnetic brake device 160 where so-called escape of a molten steel flow may be secured. By securing such area, it becomes possible to meet a wider range of casting conditions.

As described above, in this embodiment, the continuous casting method using the electromagnetic force generating device 170 provided with the electromagnetic stirring device 150 and the electromagnetic brake device 160 described above may be implemented.

In the continuous casting method according to this embodiment, the continuous casting is performed while applying the electromagnetic force to generate the swirling flow in the horizontal plane to the molten steel 2 in the mold 110 by the electromagnetic stirring device 150 installed above the electromagnetic brake device 160, and applying the electromagnetic force in the direction to brake the discharge flow to the discharge flow of the molten steel 2 from the immersion nozzle 6 into the mold 110 by the electromagnetic brake device 160. Furthermore, the continuous casting method according to this embodiment includes a drift detecting step of detecting the drift of the discharge flow, and a current controlling step of controlling the current flowing in the first circuit 181*a* and the current flowing in the second circuit 181*b* as described in detail in following [2-1. Detail of control performed by control device].

Meanwhile, in a case where the electromagnetic stirring device 150 is omitted from the configuration of the electromagnetic force generating device 170, although the electromagnetic force to generate the swirling flow in the horizontal plane is not applied to the molten steel 2 in the mold 110, the continuous casting is performed while applying the electromagnetic force in the direction to brake the discharge flow to the discharge flow of the molten steel 2 from the immersion nozzle 6 into the mold 110 by the electromagnetic brake device 160.

[2-1. Detail of Control Performed by Control Device]

Next, the control performed by the control device 187 of the mold equipment 10 is described in detail.

In this embodiment, the control device 187 detects the drift of the discharge flow between the pair of discharge holes 61 of the immersion nozzle 6, and controls the current flowing through the first circuit 181*a* and the current flowing through the second circuit 181*b* on the basis of a detection result. Specifically, in a case where the control device 187 detects the drift of the discharge flow, this controls the current flowing through the first circuit 181*a* and the current flowing through the second circuit 181*b* such that the drift of the discharge flow is suppressed and a flow volume and a flow speed of the discharge flow between the pair of discharge holes 61 are made uniform.

Figure 8:
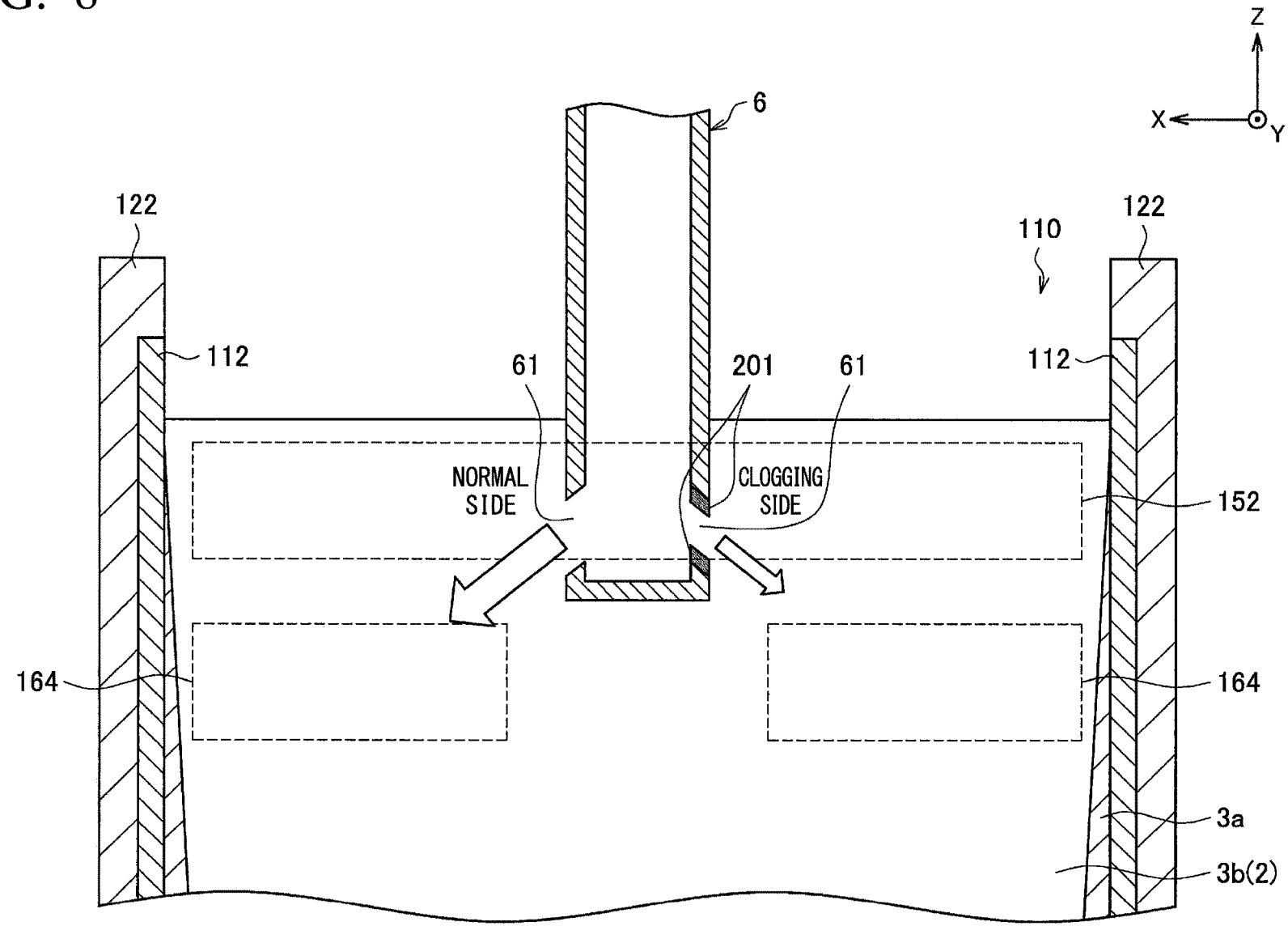
FIG. 8 is a view schematically illustrating a state of the discharge flows in a case where there is a difference in opening area between a pair of discharge holes due to adhesion of non-metallic inclusions to the discharge holes of an immersion nozzle.

As described above, in the course of the operation of the continuous casting, the drift of the discharge flow is generated when the difference in opening area occurs between the pair of discharge holes 61 due to uneven adhesion of the non-metal inclusions contained in the molten steel to each of the discharge holes 61 of the immersion nozzle 6. FIG. 8 is a view schematically illustrating a state of the discharge flows of the molten steel 2 in a case where there is the difference in opening area between the pair of discharge holes 61 due to the adhesion of the non-metal inclusions 201 to the discharge holes 61 of the immersion nozzle 6. In FIG. 8, magnitude of the flow volume and flow speed of the discharge flow from each of the discharge holes 61 is schematically indicated by a size of arrow.

As illustrated in FIG. 8, suppose that, for example, the non-metal inclusions 201 are not adhered to the discharge hole 61 on one side in the mold long side direction of the immersion nozzle 6 but the non-metal inclusions 201 are adhered to the discharge hole 61 on the other side. Meanwhile, hereinafter, the discharge hole 61 on one side to which the non-metal inclusions 201 are not adhered is referred to as the discharge hole 61 on a normal side, and the discharge hole 61 on the other side to which the non-metal inclusions 201 are adhered is referred to as the discharge hole 61 on a clogging side. In this case, the opening area of the discharge hole 61 on the clogging side is smaller than the opening area of the discharge hole 61 on the normal side. As a result, the flow volume and flow speed of the discharge flow from the discharge hole 61 on the clogging side are smaller and lower than the flow volume and flow speed of the discharge flow from the discharge hole 61 on the normal side. As described above, the adhesion of the non-metallic inclusions 201 to each discharge hole 61 progresses unevenly between the discharge holes 61, so that the drift in which the flow volume and the flow speed of the discharge flow are different is generated.

In a case where there is no difference in opening area between the pair of discharge holes 61, the drift of the discharge flow is not generated, and the behavior of the discharge flow bounced up by the electromagnetic brake device 160 is substantially symmetrical on both the sides of the immersion nozzle 6 in the mold long side direction. In contrast, in a case where there is the difference in opening area between the pair of discharge holes 61, the drift of the discharge flow is generated, so that the behavior of the discharge flow bounced up by the electromagnetic brake device 160 is asymmetrical on both the sides of the immersion nozzle 6 in the mold long side direction.

Figure 9:
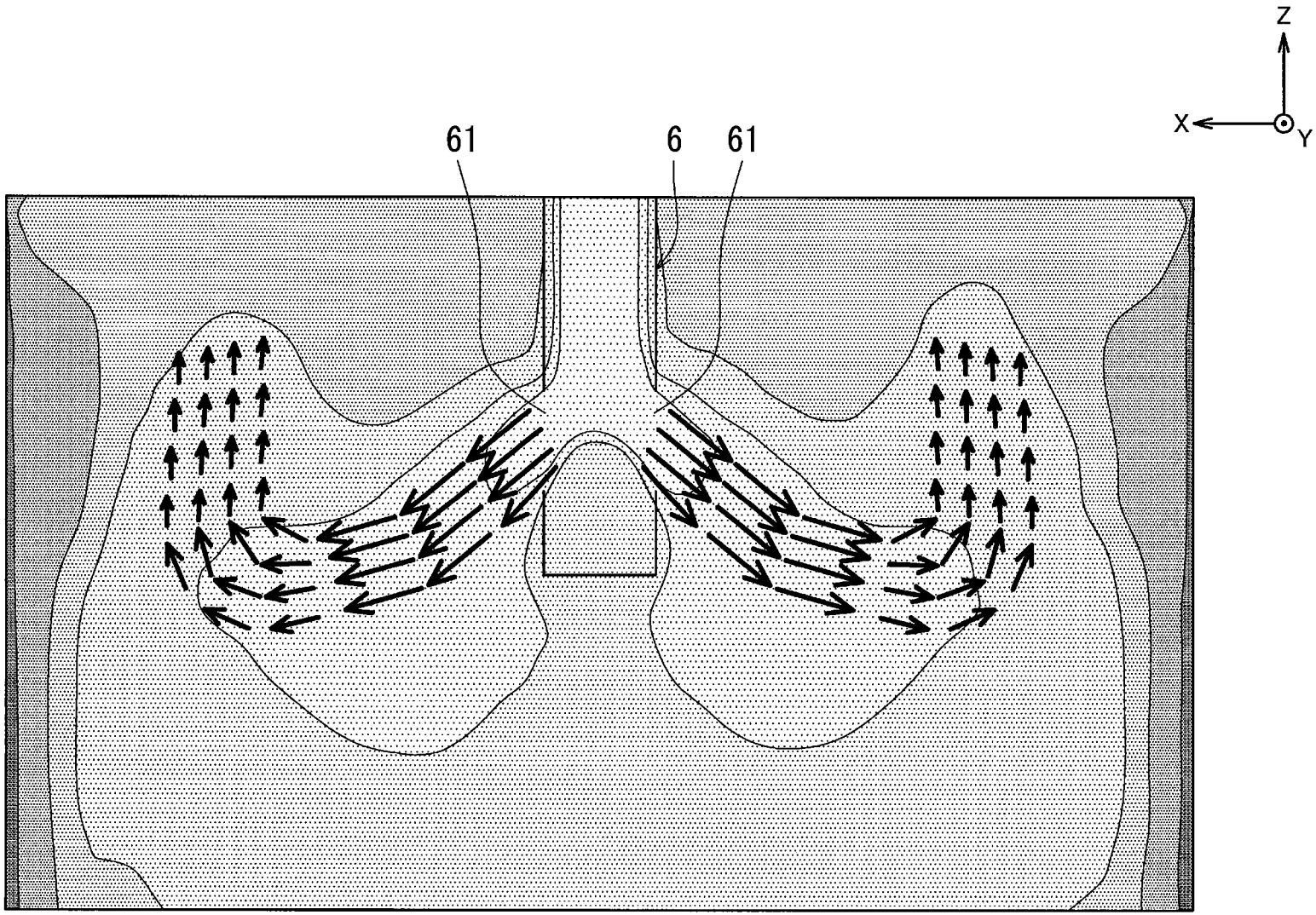
FIG. 9 is a schematic diagram of distribution of temperature and a flow speed of the molten steel in the mold in a case where the difference in opening area does not occur between the pair of discharge holes and obtained by a heat flow analysis simulation.
Figure 10:
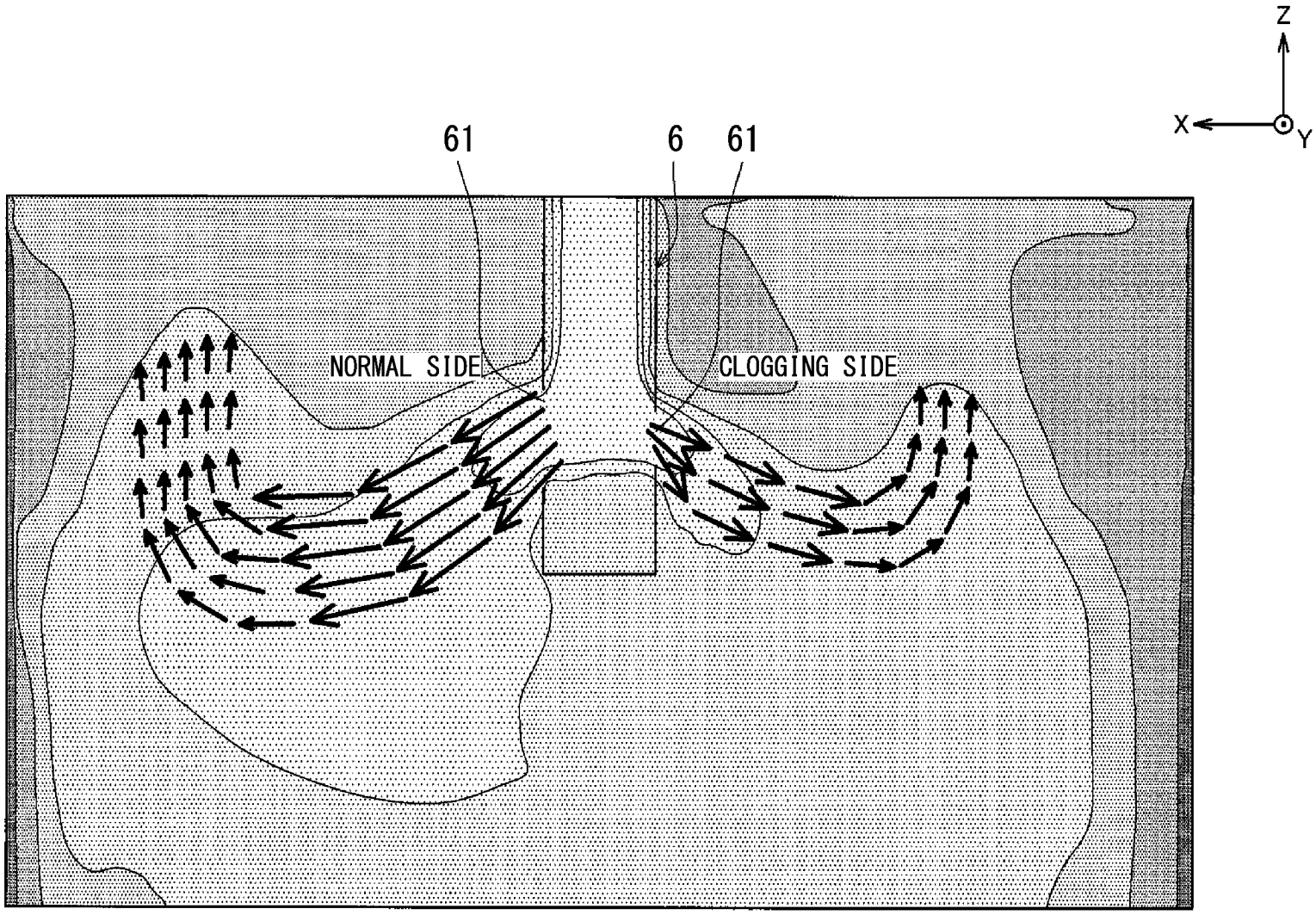
FIG. 10 is a schematic diagram of distribution of temperature and a flow speed of the molten steel in the mold in a case where the difference in opening area occurs between the pair of discharge holes obtained by a heat flow analysis simulation.

FIGS. 9 and 10 are schematic diagrams of distribution of temperature and the flow speed of the molten steel 2 in the mold 110 in a case where the difference in opening area does not occur between the pair of discharge holes 61 and in a case where this occurs obtained by a heat flow analysis simulation. In FIGS. 9 and 10, the temperature distribution of the molten steel 2 is indicated by hatching gray-scale. The lighter the hatching, the higher the temperature. In FIGS. 9 and 10, the flow speed distribution of the molten steel 2 is indicated by arrows representing speed vectors.

In the heat flow analysis simulation corresponding to a result in FIG. 9, in a model of the immersion nozzle 6, the opening areas of the pair of discharge holes 61 were set to values substantially the same. In contrast, in the heat flow analysis simulation corresponding to a result in FIG. 10, in the model of the immersion nozzle 6, as compared with the opening area of the discharge hole 61 on one side corresponding to the normal side, the opening area of the discharge hole 61 on the other side corresponding to the clogging side was set to substantially ⅓. Other simulation conditions were common between the heat flow analysis simulations corresponding to the results in FIGS. 9 and 10, and were specifically set as follows. In the heat flow analysis simulation corresponding to the results in FIGS. 9 and 10, the magnetic flux density of the magnetic flux generated on both the sides in the mold long side direction in the mold 110 by the electromagnetic brake device 160 was set to 3,000 Gauss, and a condition in which the electromagnetic stirring device 150 is not driven was used.

(Slab)

Slab size (mold size): width 1,625 mm, thickness 250 mm

Casting speed: 1.6 m/min (Electromagnetic Brake Device)

Depth of upper end of tooth from molten steel bath level: 516 mm

Tooth size: width (W2) 550 mm, height (H2) 200 mm (Immersion Nozzle)

Immersion nozzle size: inner diameter φ87 mm, outer diameter φ152 mm

Depth of bottom surface of immersion nozzle from molten steel bath level (bottom surface depth): 390 mm Cross-sectional surface size of discharge hole: width 74 mm, height 99 mm Inclination angle from horizontal direction of discharge hole: 45°

According to the result of the heat flow analysis simulation illustrated in FIG. 9, it was confirmed that, in a case where there is no difference in opening area between the pair of discharge holes 61, the drift of the discharge flow is not generated, and the distribution of the flow volume and the flow speed of the discharge flow are substantially the same on both the sides of the immersion nozzle 6 in the mold long side direction. It was also confirmed that the behavior of the discharge flow bounced up by the electromagnetic brake device 160 is substantially symmetrical on both the sides of the immersion nozzle 6 in the mold long side direction.

In contrast, according to the result of the heat flow analysis simulation illustrated in FIG. 10, it was confirmed that, in a case where there is the difference in opening area between the pair of discharge holes 61, the drift of the discharge flow is generated, and the flow volume and the flow speed of the discharge flow from the discharge hole 61 on clogging side are smaller and lower than those of the discharge flow from the discharge hole 61 on the normal side. It was also confirmed that the behavior of the discharge flow bounced up by the electromagnetic brake device 160 is asymmetrical on both the sides of the immersion nozzle 6 in the mold long side direction.

Herein, a braking force F applied to the discharge flow from the discharge hole 61 by the electromagnetic brake device 160 is expressed by following expression (1).

[Mathematical Expression 1]

$$F=\sigma(U\times B\times B) \quad (1)$$

Meanwhile, in expression (1), 6 represents conductivity of the molten steel 2, U represents a speed vector of the discharge flow, and B represents a magnetic flux density vector of the magnetic flux generated in the mold 110 by the electromagnetic brake device 160.

According to expression (1), it is understood that magnitude of the braking force applied to the discharge flow has a correlation with the magnitude of the magnetic flux density of the magnetic flux generated in the mold 110. Therefore, by independently controlling the magnetic flux density of the magnetic flux generated in the mold 110 between one side and the other side of the immersion nozzle 6 in the mold long side direction, it is possible to independently control the braking force applied to the discharge flow between one side and the other side of the immersion nozzle 6 in the mold long side direction. Therefore, for example, by increasing only the magnetic flux density of the magnetic flux generated on one side (that is, the normal side) of the immersion nozzle 6 in the mold long side direction in the mold 110, the braking force applied to the discharge flow on the normal side may be effectively increased as compared with that on the clogging side. Therefore, it is expected that the drift of the discharge flow is suppressed.

Meanwhile, according to expression (1), it is understood that the magnitude of the braking force applied to the discharge flow also has a correlation with the speed of the discharge flow. Therefore, since the speed of the discharge flow on the normal side is higher than that on the close side, the braking force applied to the discharge flow on the normal side is larger than that on the close side. As a result, the behavior of the discharge flow discharged from each discharge hole 61 advances in a direction in which the drift is suppressed. However, an effect of suppressing the drift only by such an automatic braking force generated according to the speed of the discharge flow is not sufficient.

Herein, as a conventional technology for independently controlling the magnetic flux density of the magnetic flux generated in the mold 110 by the electromagnetic brake device 160 between one side and the other side of the immersion nozzle 6 in the mold long side direction, Patent Document 2 discloses the technology of arranging separate electromagnetic brake devices on the outer side of the pair of short side mold plates. In this case, the electromagnetic brake core of each electromagnetic brake device is, specifically, provided with a pair of teeth provided so as to face the long side mold plate 111 so as to sandwich the mold 110 in the mold short side direction, and the connecting unit which connects the pair of teeth across the outer side surface of the short side mold plate 112. Then, such electromagnetic brake devices are installed on both sides in the mold long side direction of the mold 110. However, in this case, there is a problem that a weight of the mold equipment is likely to increase. The continuous casting is generally performed while vibrating the mold 110 by a vibrating device. Therefore, in a case where the weight of the mold equipment increases, a load on the vibrating device increases. A width varying device for changing a width of the mold during the continuous casting is generally installed on the outer side surface of the short side mold plate 112. Therefore, it is difficult to install the electromagnetic brake core having a shape straddling the outer side surface of the short side mold plate 112 so as not to interfere with the width varying device.

In contrast, the electromagnetic brake core 162 of each electromagnetic brake device 160 according to this embodiment has a shape that does not straddle the outer side surface of the short side mold plate 112 as illustrated in FIG. 7, so that this may avoid the above-described problem. However, in the electromagnetic brake core 162, the pair of teeth 164 provided on both sides of the immersion nozzle 6 in the mold long side direction are connected by the connecting unit 165, so that a part of the magnetic flux generated by the magnetic field generated by each coil 163 forms a magnetic circuit from one tooth 164 to the other tooth 164 through the connecting unit 165 in the electromagnetic brake core 162. As a result, as illustrated in FIG. 7, a continuous magnetic circuit C10 passing through the pair of electromagnetic brake cores 162 is formed. Therefore, it was expected that, in a case where only the magnetic flux density of the magnetic flux generated on one side (normal side) of the immersion nozzle 6 in the mold long side direction in the mold 110 is increased, the magnetic flux density of the magnetic flux generated on the other side (clogging side) of the immersion nozzle 6 in the mold long side direction in the mold 110 also increases to no small extent.

Herein, by an electromagnetic field analysis simulation, the present inventors used the electromagnetic brake device 160 according to this embodiment in which the electromagnetic brake core 162 is arranged as described above, and found that the magnetic flux density of the magnetic flux generated in the mold 110 may be appropriately independently controlled between one side and the other side of the immersion nozzle 6 in the mold long side direction.

Figure 11:
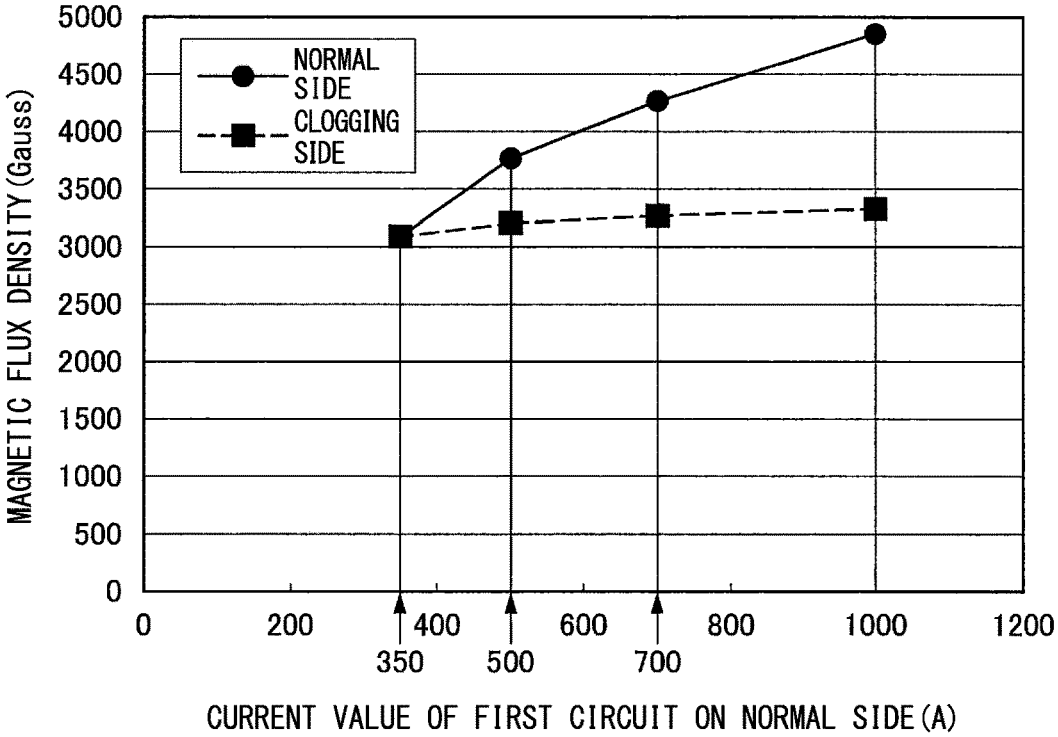
FIG. 11 is a view illustrating a relationship between a current value of current flowing through a circuit on a normal side and each of magnetic flux densities of magnetic fluxes generated on the normal side and the clogging side when the current value of the current flowing through the circuit on the clogging side is fixed obtained by an electromagnetic field analysis simulation.
Figure 12:
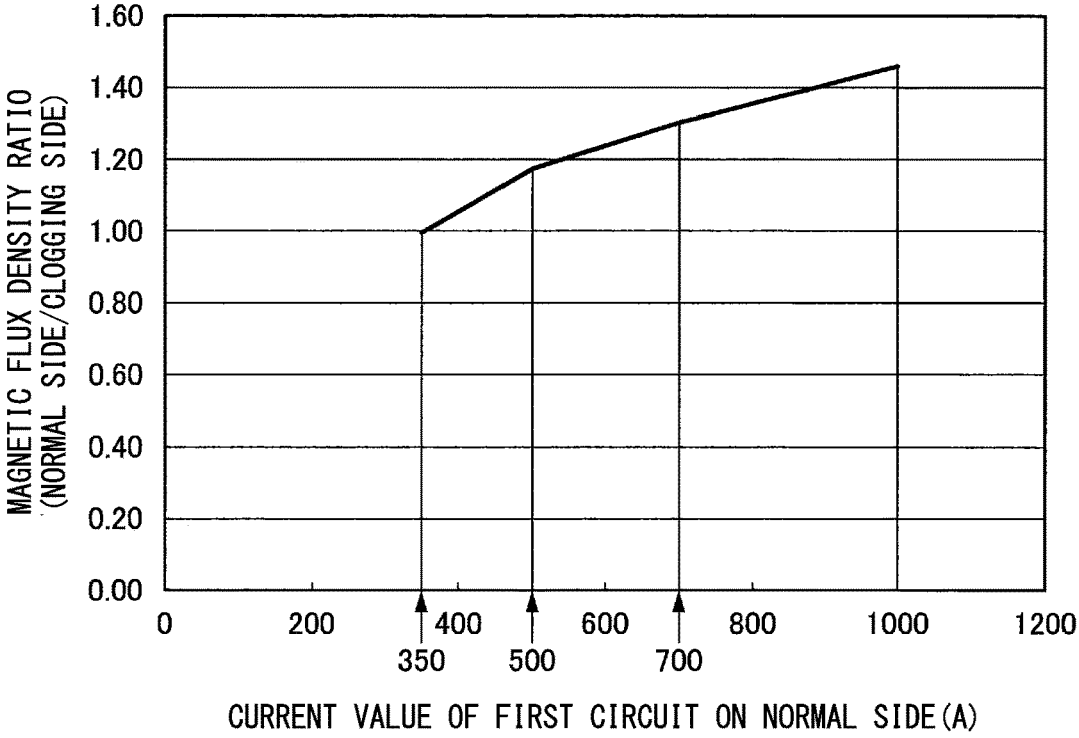
FIG. 12 is a view illustrating a relationship between the current value of the current flowing through the circuit on the normal side and a ratio of the magnetic flux densities of the magnetic fluxes generated on the normal side and the clogging side when the current value of the current flowing through the circuit on the clogging side is fixed obtained by the electromagnetic field analysis simulation.

FIG. 11 is a view illustrating a relationship between the current value of the current flowing through the circuit on the normal side and each of the magnetic flux densities of the magnetic fluxes generated on the normal side and the clogging side when the current value of the current flowing through the circuit on the clogging side is fixed obtained by the electromagnetic field analysis simulation. FIG. 12 is a view illustrating a relationship between the current value of the current flowing through the circuit on the normal side and a ratio (magnetic flus density ratio) of the magnetic flux densities of the magnetic fluxes generated on the normal side and the clogging side when the current value of the current flowing through the circuit on the clogging side is fixed obtained by the electromagnetic field analysis simulation. In the present specification, the magnetic flux density ratio is specifically intended to mean the ratio of the magnetic flux density of the magnetic flux generated on the normal side to the magnetic flux density of the magnetic flux generated on the clogging side. In the electromagnetic field analysis simulation corresponding to the results in FIGS. 11 and 12, an initial value of the current value was set to 350 A for both the first circuit 181*a* which is the circuit on the normal side and the second circuit 181*b* which is the circuit on the clogging side. Thereafter, in a state in which the current value of the second circuit 181*b* on the clogging side was fixed at 350 A, the current value of the first circuit 181*a* on the normal side was sequentially increased to 500 A, 700 A, and 1,000 A. In this simulation, the magnetic flux density of the magnetic flux generated on each of the normal side and the clogging side in the mold 110 in such a case was examined. Meanwhile, the electromagnetic field analysis simulation is a static magnetic field analysis using a condition that the molten steel 2 in the mold 110 is stationary as a simulation condition.

With reference to FIG. 11, it is understood that, in a case where the current value of the first circuit 181*a* on the normal side is increased, the magnetic flux density of the magnetic flux generated on the clogging side in the mold 110 slightly increases, but is almost maintained, and only the magnetic flux density of the magnetic flux generated on the normal side in the mold 110 effectively increases. With reference to FIG. 12, it is understood that by increasing the current value of the first circuit 181*a* on the normal side to a value of 500 A or larger, the ratio of the magnetic flux densities of the magnetic fluxes generated on the normal side and the clogging side may be increased to 1.2 or larger. Herein, as indicated by a result of an actual machine test to be described later, by setting the ratio of the magnetic flux densities of the magnetic fluxes generated on the normal side and the clogging side to 1.2 or larger, the drift of the discharge flow may be effectively suppressed. Therefore, according to the results in FIG. 11 and FIG. 12, it may be understood that the magnetic flux density of the magnetic flux generated in the mold 110 may be appropriately independently controlled between one side and the other side of the immersion nozzle 6 in the mold long side direction.

By the way, in the control for suppressing the drift of the discharge flow, it is necessary to detect the drift of the discharge flow. As a conventional method for detecting the drift, for example, there is a technology using a detected value of an eddy current level meter installed in the vicinity of the molten steel bath level and a technology of using a detected value of a thermocouple installed on the mold plate.

In the technology of using the detected value of the eddy current level meter, specifically, a plurality of eddy current level meters is installed in positions different from each other in the horizontal direction immediately above the molten steel bath level in the mold 110, and each eddy current level meter detects a height of the molten steel bath level in an install position of each eddy current level meter. Then, the drift of the discharge flow is detected by detecting distribution in the horizontal direction of magnitude of variation in a height direction of the molten steel bath level on the basis of the detected value of each eddy current level meter. However, this method requires a large number of eddy current level meters to be installed, which causes a problem of an increased equipment cost. Furthermore, since it takes time to calibrate each eddy current level meter, which causes a problem of an increased operating cost.

In the technology of using the detected value of the thermocouple installed on the mold plate, specifically, a plurality of thermocouples is installed in positions different from each other on the mold plate, and each thermocouple detects temperature in installation position of each thermocouple. Then, the drift of the discharge flow is detected by estimating the distribution of the temperature of the molten steel 2 in the mold 110 on the basis of the detected value of each thermocouple. However, in this method, a problem occurs that detection accuracy of the drift of the discharge flow is deteriorated due to variation of the detected value of the thermocouple due to the presence of a layer of air or a layer of molten powder between the inner wall of the mold plate and the solidified shell 3*a*.

Herein, the present inventors found a method for detecting the drift of the discharge flow while avoiding the above-described problems. As such a method, the control device 187 according to this embodiment detects the drift of the discharge flow on the basis of the voltage applied to the coil 163*a* in the first circuit 181*a* and the voltage applied to the coil 163*b* in the second circuit 181*b*. Hereinafter, such detecting method of the drift of the discharge flow in this embodiment is described in detail.

Figure 13:
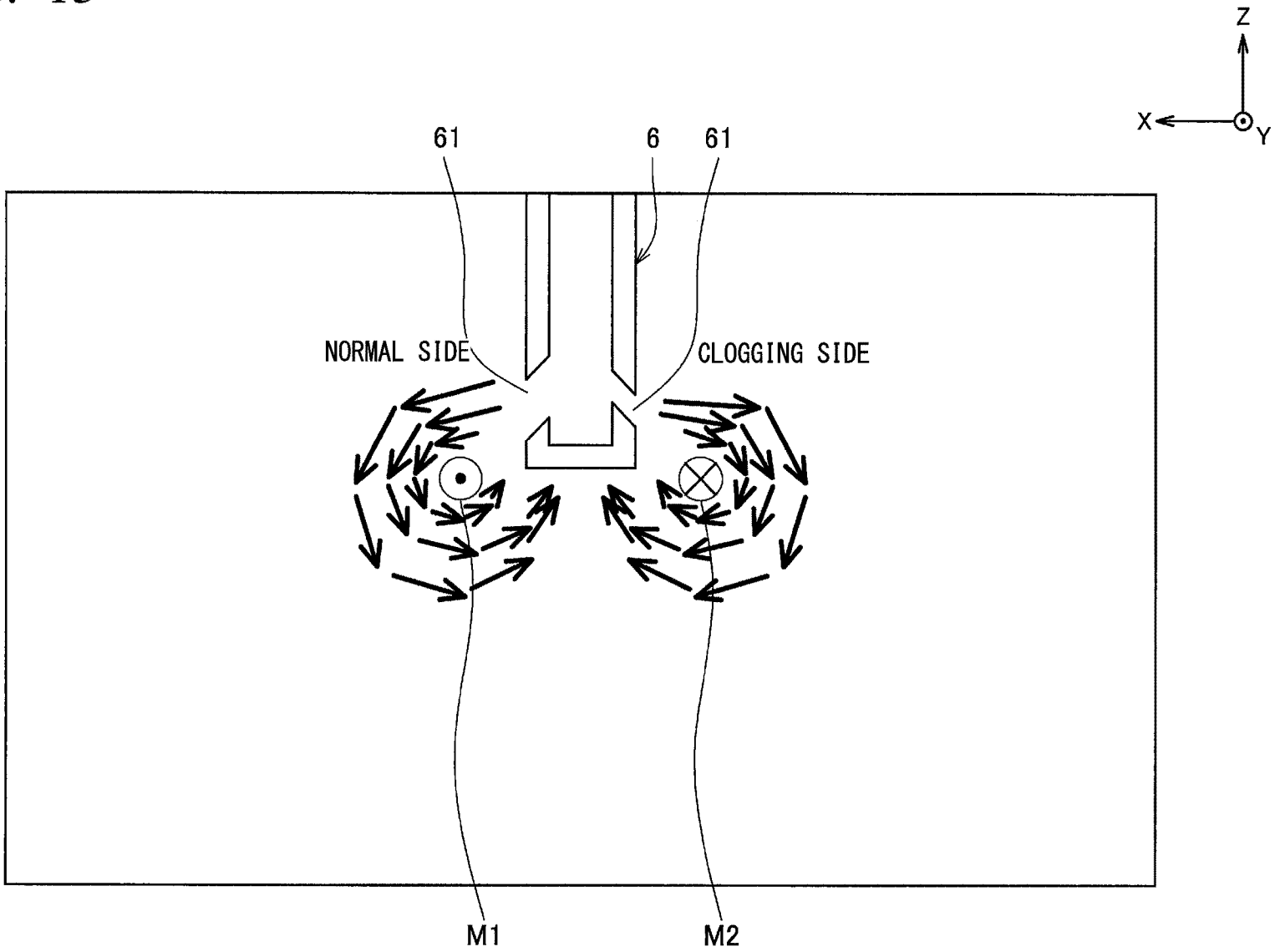
FIG. 13 is a schematic diagram illustrating distribution of an eddy current and a demagnetized field generated in the mold obtained by the electromagnetic field analysis simulation.

When the current is applied to each coil 163 of the electromagnetic brake device 160, the magnetic flux is generated in the mold 110 as described above. Furthermore, because the magnetic flux is generated in the mold 110, an eddy current is generated in the mold 110. Then, the eddy current generated in the mold 110 further generates a magnetic field. Hereinafter, the magnetic field generated by the eddy current generated in the mold 110 in this manner is referred to as a demagnetized field. FIG. 13 is a schematic diagram illustrating distribution of the eddy current and demagnetized field generated in the mold 110 obtained by the electromagnetic field analysis simulation. In FIG. 13, the eddy current generated in the mold 110 is indicated by arrows.

With reference to FIG. 13, it is understood that the eddy current is generated in a direction to generate the demagnetized field which weakens the magnetic field generated by each coil 163. Specifically, on the normal side in the mold 110, the magnetic field is generated in a direction from a front surface side to a back surface side of the drawing by the coil 163*a* of the first circuit 181*a*, and as illustrated in FIG. 13, a demagnetized field M1 is generated in a direction from the back surface side to the front surface side of the drawing so as to weaken the magnetic field by the eddy current. In contrast, on the clogging side in the mold 110, the magnetic field is generated in a direction from the back surface side to the front surface side of the drawing by the coil 163*b* of the second circuit 181*b*, and as illustrated in FIG. 13, a demagnetized field M2 is generated in a direction from the front surface side to the back surface side of the drawing so as to weaken the magnetic field by the eddy current.

Herein, an eddy current j generated in the mold 110 is represented by following expression (2).

[Mathematical Expression 2]

$$j=\sigma(U\times B) \tag{2}$$

A magnetic flux Φ of the demagnetized field generated in the mold 110 is represented by following expression (3).

[Mathematical Expression 3]

$$\Phi=\oint_C j\,dl=\oint_C \sigma(U\times B)\,dl \tag{3}$$

Meanwhile, in expression (3), C represents a closed curve surrounding the magnetic flux Φ of the demagnetized field, and dl represents a line element of the closed curve.

As described above, an induction voltage is generated in each circuit of the electromagnetic brake device 160 due to the generation of the demagnetized field. Specifically, regarding the current flowing through each circuit of the electromagnetic brake device 160, the induction voltage is generated so as to increase a component in a direction of generating the magnetic field which weakens the demagnetized field by the coil 163.

Herein, an induction voltage V generated in each circuit of the electromagnetic brake device 160 is represented by following expression (4).

[Mathematical Expression 4]

$$V = -n\frac{\partial \Phi}{\partial t} \tag{4}$$

Meanwhile, in expression (4), t represents time, and n represents the number of windings of each coil 163 in each circuit.

In a case where the drift of the discharge flow is generated, as described above, the flow volume and the flow speed of the discharge flow on the normal side are larger and higher than those on the clogging side. At that time, a change over time in a flow state of the discharge flow on the normal side is larger than that on the clogging side. Specifically, the change over time in the flow volume and the flow speed of the discharge flow on the normal side is larger than that on the clogging side. Therefore, according to expressions (3) and (4), the electromotive force generated in the first circuit 181*a* on the normal side is larger than that in the second circuit 181*b* on the clogging side. Therefore, a difference in induction voltage occurs between the first circuit 181*a* and the second circuit 181*b*.

The control device 187 according to this embodiment focuses on the difference in induction voltage between the circuits generated in this manner, and specifically detects the drift of the discharge from on the basis of the difference between the electromotive force generated in the first circuit 181*a* due to the change over time of the flow state of the discharge flow from the discharge hole 61 on one side in the mold long side direction (induction voltage described above) and the electromotive force generated in the second circuit 181*b* due to the change over time of the flow state of the discharge flow from the discharge hole 61 on the other side in the mold long side direction (induction voltage described above). For example, the control device 187 detects the drift of the discharge flow on the basis of the difference between the voltage applied to the coil 163*a* in the first circuit 181*a* (hereinafter, also referred to as the voltage of the first circuit 181*a*) and the voltage applied to the coil 163*b* in the second circuit 181*b* (hereinafter, also referred to as the voltage of the second circuit 181*b*). Herein, the difference between the voltage of the first circuit 181*a* and the voltage of the second circuit 181*b* corresponds to an index of the difference between the induction voltage generated in the first circuit 181*a* and the induction voltage generated in the second circuit 181*b*. Specifically, the control device 187 determines that the drift of the discharge flow occurs in a case where the difference between the voltage of the first circuit 181*a* and the voltage of the second circuit 181*b* exceeds a threshold. The threshold is, for example, appropriately set to a value such that the difference between the voltage of the first circuit 181*a* and the voltage of the second circuit 181*b* may be appropriately detected on the basis of detection errors of the voltage sensors 183*a* and 183*b* or variation in amplification factor of a signal by the amplifier 185.

In the continuous casting, a case where the drift of the discharge flow is not generated is basically assumed, and the current values of the currents flowing through the first circuit 181*a* and the second circuit 181*b* are set to the same value. Therefore, in a case where the drift is not generated, the induction voltage generated in each circuit is substantially the same, so that the voltage of the first circuit 181*a* and the voltage of the second circuit 181*b* are substantially the same. In contrast, in a case where the drift is generated, a difference in induction voltage occurs between the circuits, so that the difference in voltage between the first circuit 181*a* and the second circuit 181*b* occurs. Therefore, according to this embodiment, it is possible to appropriately detect the drift of the discharge flow.

Meanwhile, in a case where the flow volume of the discharge flow is relatively small, as is understood from expressions (3) and (4), the induction voltage generated in each circuit is relatively small, so that the difference between the voltage of the first circuit 181*a* and the voltage of the second circuit 181*b* becomes relatively small. Therefore, although there is a case where the drift of the discharge flow is not detected by the control device 187, in such a case, an influence of the drift on the difference in behavior of the discharge flow between the normal side and the clogging side in the mold 110 is also relatively small, so that a problem that the quality of the slab 3 is deteriorated due to the drift is less likely to occur.

Then, as described above, the control device 187 according to this embodiment controls the current of each circuit in a case of detecting the drift of the discharge flow. Specifically, in a case where the control device 187 detects the drift, this controls the current flowing through the first circuit 181*a* and the current flowing through the second circuit 181*b* such that the difference between the electromotive force generated in the first circuit 181*a* due to the change over time of the flow state of the discharge flow from the discharge hole 61 on one side in the mold long side direction (induction voltage described above) and the electromotive force generated in the second circuit 181*b* due to the change over time of the flow state of the discharge flow from the discharge hole 61 on the other side in the mold long side direction (induction voltage described above) becomes small.

For example, in the control device 187, in a case where the first circuit 181*a* corresponds to the circuit on the normal side, the induction voltage generated in the first circuit 181*a* is larger than the induction voltage generated in the second circuit 181*b*. In this case, the control device 187 may increase the current value of the first circuit 181*a* on the normal side, thereby increasing the magnetic flux density of the magnetic flux generated on the normal side in the mold 110, so that this may decrease the flow volume and the flow speed of the discharge flow from the discharge hole 61 on the normal side. As a result, the induction voltage generated in the first circuit 181*a* may be reduced, so that it is possible to decrease the difference between the induction voltage generated in the first circuit 181*a* and the induction voltage generated in the second circuit 181*b*. At that time, specifically, the control device 187 stops an increase in current value of the first circuit 181*a* on the normal side in a case where the difference between the induction voltage generated in the first circuit 181*a* and the induction voltage generated in the second circuit 181*b* is equal to or smaller than a reference value. As a result, in a case where the drift of the discharge flow is generated, the drift may be appropriately suppressed. The above-described reference value is appropriately set to, for example, a value which may suppress the drift of the discharge flow to the extent that the quality of the slab 3 may be maintained at the required quality.

Meanwhile, the control device 187 may also control the current flowing through the first circuit 181*a* and the current flowing through the second circuit 181*b* such that the difference between the induction voltage generated in the first circuit 181*a* and the induction voltage generated in the second circuit 181*b* becomes small by decreasing the current value of the second circuit 181*b* on the clogging side. In this manner, the control device 187 may control the current flowing through the first circuit 181*a* and the current flowing through the second circuit 181*b* such that the difference between the induction voltage generated in the first circuit 181*a* and the induction voltage generated in the second circuit 181*b* becomes small by increasing the current value of the circuit on a side on which the electromotive force is large or by decreasing the current value of the circuit on a side on which the electromotive force is small or combination thereof.

As described above, in this embodiment, the control device 187 detects the drift of the discharge flow on the basis of the voltage applied to the coil 163*a* in the first circuit 181*a* and the voltage applied to the coil 163*b* in the second circuit 181*b*. As a result, it becomes possible to appropriately detect the drift of the discharge flow while suppressing an increase in equipment cost, an increase in operating cost, and deterioration in detection accuracy of the drift. The electromagnetic brake core 162 of each electromagnetic brake device 160 is arranged on the outer side of each of the pair of long side mold plates 111, and has a shape not straddling the outer side surface of the short side mold plate 112, and the control device 187 controls the current flowing through the first circuit 181*a* and the current flowing through the second circuit 181*b* on the basis of the detection result of the drift. As a result, it becomes possible to appropriately suppress the drift while suppressing an increase in weight of the mold equipment 10 and interference between the electromagnetic brake core 162 and the width varying device. Therefore, even in a case where there is the difference in opening area between the pair of discharge holes 61 due to the adhesion of the non-metallic inclusions to the discharge hole 61 of the immersion nozzle 6, it becomes possible to suppress the behavior of the discharge flow bounced up by the electromagnetic brake device 160 from being asymmetrical on both the sides of the immersion nozzle in the mold long side direction. Therefore, the flow of the molten steel 2 in the mold 110 may be appropriately controlled, so that the quality of the slab 3 may be further improved.

[2-2. Detail of Installation Position of Electromagnetic Force Generating Device]

In the electromagnetic force generating device 170, by appropriately setting the heights of the electromagnetic stirring device 150 and the electromagnetic brake device 160, and the installation positions of the electromagnetic stirring device 150 and the electromagnetic brake device 160 in the Z-axis direction, the quality of the slab 3 may be further improved. Herein, the appropriate heights of the electromagnetic stirring device 150 and the electromagnetic brake device 160, and the appropriate installation positions of the electromagnetic stirring device 150 and the electromagnetic brake device 160 in the Z-axis direction in the electromagnetic force generating device 170 are described.

In the electromagnetic stirring device 150 and the electromagnetic brake device 160, it may be said that the higher the heights of the electromagnetic stirring core 152 and the electromagnetic brake core 162, the higher the performance of applying the electromagnetic force. For example, the performance of the electromagnetic brake device 160 depends on a cross-sectional area (height H2 in the Z-axis direction×width W2 in the X-axis direction) of the tooth 164 of the electromagnetic brake core 162 in the X-Z plane, a value of the direct current to be applied, and the number of windings of the coil 163. Therefore, in a case where both the electromagnetic stirring device 150 and the electromagnetic brake device 160 are installed in the mold 110, it is significantly important how to set the installation positions of the electromagnetic stirring core 152 and the electromagnetic brake core 162, more specifically, a ratio of the heights of the electromagnetic stirring core 152 and the electromagnetic brake core 162 in a limited installation space from a viewpoint of more effective exertion of the performance of each device for improving the quality of the slab 3.

Herein, as disclosed in Patent Document 1 above, a method of using both the electromagnetic stirring device and the electromagnetic brake device in the continuous casting has been conventionally proposed. However, in practice, even if both the electromagnetic stirring device and the electromagnetic brake device are combined, there often is a case where the quality of the slab is deteriorated as compared with a case where the electromagnetic stirring device or the electromagnetic brake device is used alone. This is because it is not always possible to easily obtain the advantages of both the devices only by simply installing both the devices but there also is a case where the devices cancel out the advantages each other depending on the configuration and installation position of each device. In Patent Document 1 described above also, the specific device configuration is not clearly disclosed, and the heights of the cores of both the devices are not clearly disclosed. That is, in the conventional method, there is a possibility that the effect of improving the quality of the slab by providing both the electromagnetic stirring device and the electromagnetic brake device cannot be sufficiently obtained.

In contrast, in this embodiment, as described below, such an appropriate ratio of the heights of the electromagnetic stirring core 152 and the electromagnetic brake core 162 is determined that the quality of the slab 3 may be further secured even in high-speed casting. This makes it possible to more effectively obtain the effect of improving productivity while securing the quality of the slab 3 together with the configuration of the electromagnetic force generating device 170 described above.

Herein, the casting speed in the continuous casting varies significantly depending on a slab size and a product type, but is generally about 0.6 to 2.0 m/min, and the continuous casting at a speed exceeding 1.6 m/min is referred to as the high-speed casting. Conventionally, for automobile exterior materials which require a high quality, it is difficult to secure the quality with the high-speed casting in which the casting speed exceeds 1.6 m/min, so that about 1.4 m/min is a normal casting speed. Therefore, herein, as an example, a specific target is set to secure the quality of the slab 3 equivalent to or higher than that in a case where the continuous casting is performed at a conventional lower casting speed even in the high-speed casting in which the casting speed exceeds 1.6 m/min, and the ratio of the heights of the electromagnetic stirring core 152 and the electromagnetic brake core 162 which may satisfy the target is described in detail.

As described above, in this embodiment, in order to secure the space for installing the electromagnetic stirring device 150 and the electromagnetic brake device 160 in the center of the mold 110 in the Z-axis direction, the water boxes 130 and 140 are arranged in the upper and lower portions of the mold 110, respectively. Herein, even when the electromagnetic stirring core 152 is located above the molten steel bath level, the effect cannot be obtained. Therefore, the electromagnetic stirring core 152 should be installed below the molten steel bath level. In order to effectively apply the magnetic field to the discharge flow, the electromagnetic brake core 162 is preferably located in the vicinity of the discharge hole of the immersion nozzle 6. In a case where the water boxes 130 and 140 are arranged as described above, since the discharge hole of the immersion nozzle 6 is located above the lower water box 140 in general arrangement, the electromagnetic brake core 162 should also be arranged above the lower water box 140. Therefore, a height H0 of a space (hereinafter, also referred to as an effective space) in which the effect may be obtained by installing the electromagnetic stirring core 152 and the electromagnetic brake core 162 is a height from the molten steel bath level to the upper end of the lower water box 140 (refer to FIG. 2).

In this embodiment, in order to make the most effective use of the effective space, the electromagnetic stirring core 152 is installed so that the upper end of the electromagnetic stirring core 152 is substantially at the same height as the molten steel bath level. At that time, when a height of the electromagnetic stirring core 152 of the electromagnetic stirring device 150 is set to H1, a height of the case 151 is set to H3, a height of the electromagnetic brake core 162 of the electromagnetic brake device 160 is set to H2, and a height of the case 161 is set to H4, following expression (5) is established.

[Mathematical Expression 5]

$$H1+\frac{H3-H1}{2}+H4=\frac{H1+H3}{2}+H4\leq H0 \tag{5}$$

In other words, it is required to define a ratio H1/H2 between the height H1 of the electromagnetic stirring core 152 and the height H2 of the electromagnetic brake core 162 (hereinafter, also referred to as core height ratio H1/H2) while satisfying expression (5) described above. The heights H0 to H4 are described below.

(Regarding Height H0 of Effective Space)

As described above, in the electromagnetic stirring device 150 and the electromagnetic brake device 160, it may be said that the higher the heights of the electromagnetic stirring core 152 and the electromagnetic brake core 162, the higher the performance of applying the electromagnetic force. Therefore, in this embodiment, the mold equipment 10 is configured so that the height H0 of the effective space is as high as possible so that both the devices may further exert the performance. Specifically, in order to increase the height H0 of the effective space, it is sufficient to increase the length of the mold 110 in the Z-axis direction. In contrast, as described above, in consideration of a cooling performance of the slab 3, the length from the molten steel bath level to the lower end of the mold 110 is desirably about 1,000 mm or shorter. Therefore, in this embodiment, in order to maximize the height H0 of the effective space while securing the cooling performance of the slab 3, the mold 110 is formed such that the length from the molten steel bath level to the lower end of the mold 110 is about 1,000 mm.

Herein, if it is attempted to configure the lower water box 140 so as to store an amount of water sufficient for obtaining a sufficient cooling performance, the height of the lower water box 140 needs to be at least about 200 mm on the basis of past operation results and the like. Therefore, the height H0 of the effective space is about 800 mm or lower.

(Regarding Heights H3 and H4 of Cases of Electromagnetic Stirring Device and Electromagnetic Brake Device)

As described above, the coil 153 of the electromagnetic stirring device 150 is formed by winding two to four layers of conductive wire having a cross-sectional size of about 10 mm×10 mm around the electromagnetic stirring core 152. Therefore, the height of the electromagnetic stirring core 152 including the coil 153 is about H1+80 mm or higher. Considering the space between the inner wall of the case 151 and the electromagnetic stirring core 152 and the coil 153, the height H3 of the case 151 is about H1+200 mm or higher.

Regarding the electromagnetic brake device 160 similarly, the height of the electromagnetic brake core 162 including the coil 163 is about H2+80 mm or higher. Considering the space between the inner wall of the case 161 and the electromagnetic brake core 162 and the coil 163, the height H4 of the case 161 is about H2+200 mm or higher.

(Range that H1+H2 May Take)

By substituting values of H0, H3, and H4 described above into expression (5) described above, following expression (6) is obtained.

[Mathematical Expression 6]

$$H1+H2\leq 500\text{ mm} \tag{6}$$

That is, the electromagnetic stirring core 152 and the electromagnetic brake core 162 need to be configured such that the sum H1+H2 of their heights is about 500 mm or smaller. Hereinafter, an appropriate core height ratio H1/H2 is examined so that the effect of improving the quality of the slab 3 may be sufficiently obtained while satisfying expression (6) described above.

(Regarding Core Height Ratio H1/H2)

In this embodiment, an appropriate range of the core height ratio H1/H2 is set by defining a range of the height H1 of the electromagnetic stirring core 152 so that the effect of electromagnetic stirring may be obtained more certainly.

As described above, in the electromagnetic stirring, by flowing the molten steel 2 at the solidified shell interface, the cleaning effect of suppressing capture of inclusions in the solidified shell 3*a* is obtained, so that the surface quality of the slab 3 may be improved. In contrast, the thickness of the solidified shell 3*a* in the mold 110 increases in the lower portion of the mold 110. Since the effect of electromagnetic stirring is exerted on the unsolidified portion 3*b* inside the solidified shell 3*a*, the height H1 of the electromagnetic stirring core 152 may be determined depending on the thickness up to which the surface quality of the slab 3 is required to be secured.

Herein, in a product type which requires a strict surface quality, a step of grinding a surface layer of the slab 3 after the casting by several millimeters is often performed. A grinding depth is about 2 mm to 5 mm. Therefore, in the product type which requires such strict surface quality, even when the electromagnetic stirring is performed in the mold 110 in a range of the thickness of the solidified shell 3*a* of smaller than 2 mm to 5 mm, the surface layer of the slab 3 from which the impurities are reduced by the electromagnetic stirring is removed at a subsequent grinding step. In other words, the effect of improving the surface quality of the slab 3 cannot be obtained unless the electromagnetic stirring is performed in a range in which the thickness of the solidified shell 3*a* is 2 mm to 5 mm or larger in the mold 110.

It is known that the solidified shell 3*a* gradually grows from the molten steel bath level and the thickness thereof is represented by following expression (7). Herein, δ represents the thickness (m) of the solidified shell 3*a*, k represents a constant which depends on the cooling performance, x represents the distance from the molten steel bath level (m), and Vc represents the casting speed (m/min).

[Mathematical Expression 7]

$$\delta = k\sqrt{\frac{x}{Vc}} \tag{7}$$

Figure 14:
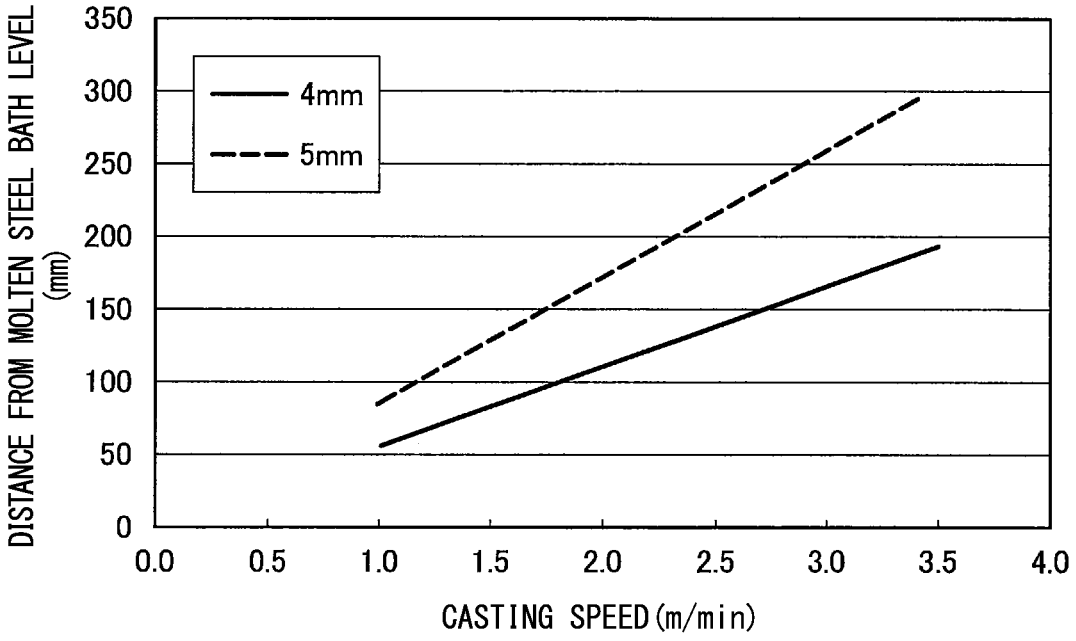
FIG. 14 is a view illustrating a relationship between a casting speed and a distance from a molten steel bath level in a case where a thickness of a solidified shell is 4 mm or 5 mm.

From expression (7) above, a relationship between the casting speed (m/min) and the distance (mm) from the molten steel bath level in a case where the thickness of the solidified shell 3*a* is 4 mm or 5 mm was obtained. FIG. 14 illustrates a result thereof. FIG. 14 is a view illustrating the relationship between the casting speed (m/min) and the distance (mm) from the molten steel bath level in a case where the thickness of the solidified shell 3*a* is 4 mm or 5 mm. In FIG. 14, the casting speed is plotted along the abscissa, the distance from the molten steel bath level is plotted along the ordinate, and the relationship therebetween in a case where the thickness of the solidified shell 3*a* is 4 mm, and where the thickness of the solidified shell 3*a* is 5 mm is plotted. Note that, in a calculation for obtaining results illustrated in FIG. 14, k=17 was set as a value corresponding to a general mold.

For example, from the results illustrated in FIG. 14, in a case where the thickness to be ground is smaller than 4 mm and it is sufficient to electromagnetically stir the molten steel 2 in a range in which the thickness of the solidified shell 3*a* is up to 4 mm, it is understood that the effect of the electromagnetic stirring may be obtained in the continuous casting at a casting speed of 3.5 m/min or slower if the height H1 of the electromagnetic stirring core 152 is set to 200 mm. In a case where the thickness to be ground is smaller than 5 mm and it is sufficient to electromagnetically stir the molten steel 2 in a range in which the thickness of the solidified shell 3*a* is up to 5 mm, it is understood that the effect of the electromagnetic stirring may be obtained in the continuous casting at a casting speed of 3.5 m/min or slower if the height H1 of the electromagnetic stirring core 152 is set to 300 mm. Meanwhile, a value of "3.5 m/min" of the casting speed corresponds to the highest casting speed that is possible in operation and equipment in a general continuous casting machine.

Herein, as described above, as an example, a case where the target is to secure the quality of the slab 3 equivalent to that in a case of performing the continuous casting at the conventional lower casting speed also in the high-speed casting in which the casting speed exceeds 1.6 m/min is considered. In a case where the casting speed exceeds 1.6 m/min, in order to obtain the effect of electromagnetic stirring even when the thickness of the solidified shell 3*a* becomes 5 mm, it is understood from FIG. 14 that the height H1 of the electromagnetic stirring core 152 should be at least about 150 mm or higher.

From the results of the examination above, in this embodiment, for example, the electromagnetic stirring core 152 is configured such that the height H1 of the electromagnetic stirring core 152 becomes about 150 mm or higher in order to obtain the effect of the electromagnetic stirring even when the thickness of the solidified shell 3*a* becomes 5 mm in the continuous casting in which the casting speed exceeds 1.6 m/min, which is relatively high.

Regarding the height H2 of the electromagnetic brake core 162, the higher the height H2, the higher the performance of the electromagnetic brake device 160 as described above. Therefore, from expression (6) described above, it is sufficient to obtain a range of H2 corresponding to a range of the height H1 of the electromagnetic stirring core 152 described above in a case where H1+H2=500 mm is satisfied. That is, the height H2 of the electromagnetic brake core 162 is about 350 mm.

From the values of the height H1 of the electromagnetic stirring core 152 and the height H2 of the electromagnetic brake core 162, the core height ratio H1/H2 in this embodiment is, for example, represented by following expression (8).

[Mathematical Expression 8]

$$0.43 \leq \frac{H1}{H2} \tag{8}$$

In summary, in this embodiment, for example, in a case where the target is to secure the quality of the slab 3 equivalent to or higher than that in a case of performing the continuous casting at the conventional lower casting speed even in a case where the casting speed exceeds 1.6 m/min, the electromagnetic stirring core 152 and the electromagnetic brake core 162 are configured such that the height H1 of the electromagnetic stirring core 152 and the height H2 of the electromagnetic brake core 162 satisfy expression (8) described above.

Meanwhile, a preferred upper limit value of the core height ratio H1/H2 may be defined by a minimum value that the height H2 of the electromagnetic brake core 162 may take. This is because, as the height H2 of the electromagnetic brake core 162 decreases, the core height ratio H1/H2 increases, but if the height H2 of the electromagnetic brake core 162 is too short, the electromagnetic brake does not function effectively and the effect low improving the inner quality of the slab 3 by the electromagnetic brake is less likely to be obtained. The minimum value of the height H2 of the electromagnetic brake core 162 at which the effect of the electromagnetic brake may be sufficiently exerted differs depending on the casting conditions such as the slab size, the product type, and the casting speed. Therefore, the minimum value of the height H2 of the electromagnetic brake core 162, that is, the upper limit value of the core height ratio H1/H2 may be defined on the basis of, for example, the actual machine test, a numerical analysis simulation simulating the casting conditions in actual operation and the like.

The appropriate heights of the electromagnetic stirring device 150 and the electromagnetic brake device 160, and the appropriate installation positions of the electromagnetic stirring device 150 and the electromagnetic brake device 160 in the Z-axis direction in the electromagnetic force generating device 170 are described above. Meanwhile, in the description above, when obtaining the relationship represented by expression (8) described above, the relationship was obtained from expression (6) above as H1+H2=500 mm. However, this embodiment is not limited to this example. As described above, it is preferable that H1+H2 is as large as possible in order to further exert the performance of the device, so that H1+H2=500 mm is satisfied in the above-described example. In contrast, for example, in consideration of workability and the like when installing the water boxes 130 and 140, the electromagnetic stirring device 150, and the electromagnetic brake device 160, there may be a case where it is preferable that there is a gap between these members in the Z-axis direction. In this manner, in a case where other elements such as the workability is more important, H1+H2=500 mm is not always necessary, and for example, the core height ratio H1/H2 may be set while setting H1+H2 to a value smaller than 500 mm such as H1+H2=450 mm.

In the description above, in a case where the casting speed exceeds 1.6 m/min, as a condition for obtaining the effect of the electromagnetic stirring even when the thickness of the solidified shell 3*a* becomes 5 mm, the minimum value of about 150 mm of the height H1 of the electromagnetic stirring core 152 is obtained from FIG. 14, and the value of the core height ratio H1/H2 of 0.43 at that time is set to the lower limit value of the core height ratio H1/H2. However, this embodiment is not limited to this example. In a case where the target casting speed is set higher, the lower limit value of the core height ratio H1/H2 may also change. That is, at the target casting speed in the actual operation, it is sufficient to obtain the minimum value of the height H1 of the electromagnetic stirring core 152 such that the effect of the electromagnetic stirring may be obtained even when the thickness of the solidified shell 3*a* becomes a predetermined thickness corresponding to the thickness removed at the grinding step from FIG. 14, and set the core height ratio H1/H2 corresponding to the value of H1 to the lower limit value of the core height ratio H1/H2.

As an example, considering the workability and the like, it is set H1+H2=450 mm, and the condition of the core height ratio H1/H2 is obtained in a case where the target is to secure the quality of the slab 3 equivalent to or higher than that in a case of performing the continuous casting at a conventional lower casting speed also at a higher casting speed of 2.0 m/min. First, from FIG. 14, a condition for obtaining the effect of the electromagnetic stirring even when the thickness of the solidified shell 3*a* becomes 5 mm, for example, in a case where the casting speed is 2.0 m/min or faster is obtained. With reference to FIG. 14, when the casting speed is 2.0 m/min, the thickness of the solidified shell becomes 5 mm in a position where the distance from the molten steel bath level is about 175 mm. Therefore, in consideration of a margin, the minimum value of the height H1 of the electromagnetic stirring core 152 which may obtain the effect of electromagnetic stirring even when the thickness of the solidified shell 3*a* becomes 5 mm is obtained as about 200 mm. At that time, since H2=250 mm is obtained from H1+H2=450 mm, the condition required for the core height ratio H1/H2 is expressed by following expression (9).

[Mathematical Expression 9]

$$0.80 \leq \frac{H1}{H2} \tag{9}$$

That is, in this embodiment, for example, in a case where the target is to secure the quality of the slab 3 equivalent to or higher than that in a case of performing the continuous casting at the conventional lower casting speed even in a case where the casting speed is 2.0 m/min, it is sufficient to configure the electromagnetic stirring core 152 and the electromagnetic brake core 162 such that expression (9) described above is satisfied. Meanwhile, the upper limit value of the core height ratio H1/H2 may be defined on the basis of the actual machine test, the numerical analysis simulation simulating the casting conditions in the actual operation and the like as described above.

In this manner, in this embodiment, the range of the core height ratio H1/H2 capable of securing the quality (surface quality and inner quality) of the slab equivalent to or higher than that in the continuous casting at the conventional lower speed even in a case where the casting speed is increased might be changed according to a specific value of the target casting speed and a specific value of H1+H2. Therefore, when setting an appropriate range of the core height ratio H1/H2, in consideration of the casting conditions at the time of the actual operation, the configuration of the continuous casting machine 1 and the like, it is sufficient to appropriately set the target casting speed and the value of H1+H2 and appropriately obtain the appropriate range of the core height ratio H1/H2 at that time by the method described above.

EXAMPLE

A result of an actual machine test performed to confirm a quality improving effect of a slab 3 in a case where the control for suppressing the drift of the discharge flow according to this embodiment described above is performed is described. In the actual machine test, an electromagnetic force generating device having a configuration similar to that of the electromagnetic force generating device 170 according to this embodiment described above was installed in a continuous casting machine (having a configuration similar to that of the continuous casting machine 1 illustrated in FIG. 1) actually used in the operation, and continuous casting was performed while controlling to suppress a drift of a discharge flow. Then, a slab 3 obtained after the casting was examined, and pinhole number density (pieces/$m^2$) was calculated as an index of the quality of the slab 3.

In the actual machine test, in order to generate a simulated drift of the discharge flow, an immersion nozzle 6 in which an opening area of a discharge hole 61 on the other side corresponding to the clogging side is set substantially ⅓ of the opening area of the discharge hole 61 on one side corresponding to the normal side was used. Principal casting conditions are as follows. In the actual machine test, a material of the slab 3 was set to low carbon steel, and a current value of current applied to a coil 153 of an electromagnetic stirring device 150 was set to 400 A.

(Slab)

Steel type: low carbon steel

Slab size (mold size): width 1,630 mm, thickness 250 mm

Casting speed: 1.6 m/min (Electromagnetic Brake Device)

Depth of upper end of tooth from molten steel bath level: 516 mm

Tooth size: width (W2) 550 mm, height (H2) 200 mm (Immersion Nozzle)

Immersion nozzle size: inner diameter φ87 mm, outer diameter φ152 mm

Depth of bottom surface of immersion nozzle from molten steel bath level (bottom surface depth): 390 mm Cross-sectional surface size of discharge hole: width 74 mm, height 99 mm Inclination angle from horizontal direction of discharge hole: 45°

In the actual machine test, as described above, first, a situation in which the drift of the discharge flow is generated was reproduced, and thereafter, a current value of a first circuit 181*a* on the normal side was increased to reduce a difference in induction voltage between circuits. Then, the pinhole number density was calculated for each portion of the manufactured slab 3 which passed through the mold 110 at different times.

Figure 15:
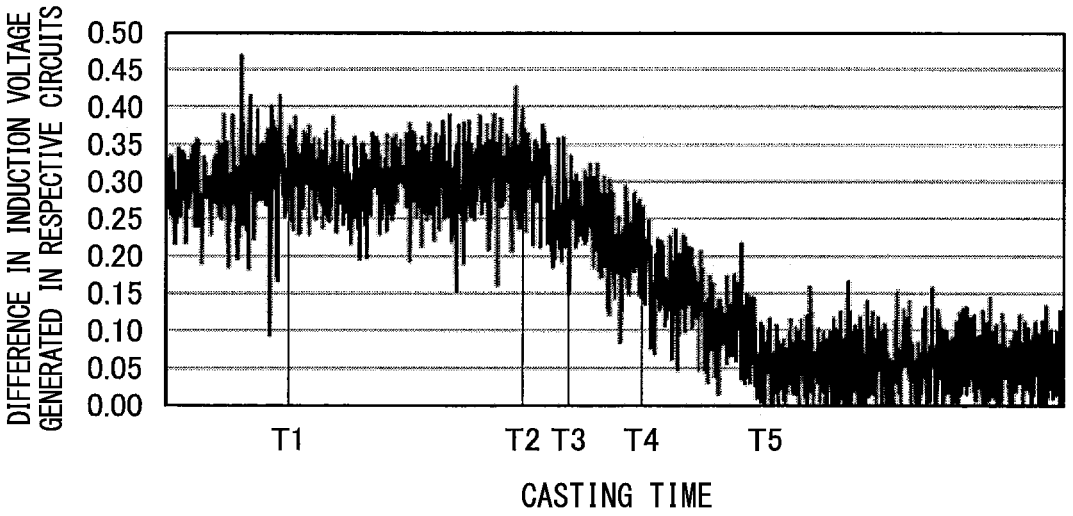
FIG. 15 is a view illustrating a transition of a difference in electromotive force (induction voltage) generated in each circuit due to a change over time in a flow state of the discharge flow in an actual machine test.
Figure 16:
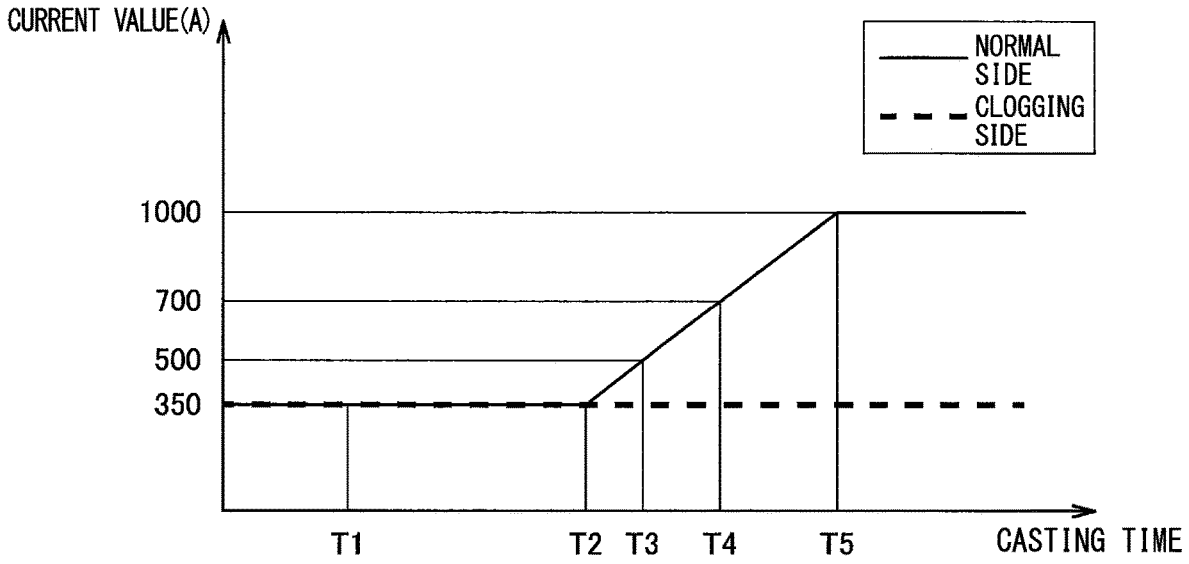
FIG. 16 is a view illustrating a transition of a current value of current flowing through each circuit in the actual machine test.

FIG. 15 is a view illustrating a transition of the difference in electromotive force (induction voltage) generated in each circuit due to a change over time in a flow state of the discharge flow in the actual machine test. FIG. 16 is a view illustrating a transition of the current value of the current flowing through each circuit in the actual machine test.

As illustrated in FIG. 15, at a casting time (for example, time T1) after the test starts, there is a difference in the induction voltage between the circuits. As illustrated in FIG. 16, at the casting time after the test starts (for example, time T1), the current values of the first circuit 181*a* on the normal side and the second circuit 181*b* on the clogging side are both set to 350 A. Thereafter, at time T2, the current value of the first circuit 181*a* on the normal side was started to increase at a constant speed. Accordingly, as illustrated in FIG. 15, at time T2, the difference in induction voltage between the circuits started to decrease. Meanwhile, the current value of the first circuit 181*a* on the normal side was 500 A at time T3 after time T2 and 700 A at time T4 after time T3. Thereafter, as the casting time advanced to time T3, T4, the difference in induction voltage between the circuits gradually decreased, and at time T5, the difference in induction voltage between the circuits became equal to or smaller than a reference value, then the increase in current value of the first circuit 181*a* on the normal side stopped. Meanwhile, the current value of the first circuit 181*a* on the normal side was maintained at 1,000 A after time T5.

Figure 17:
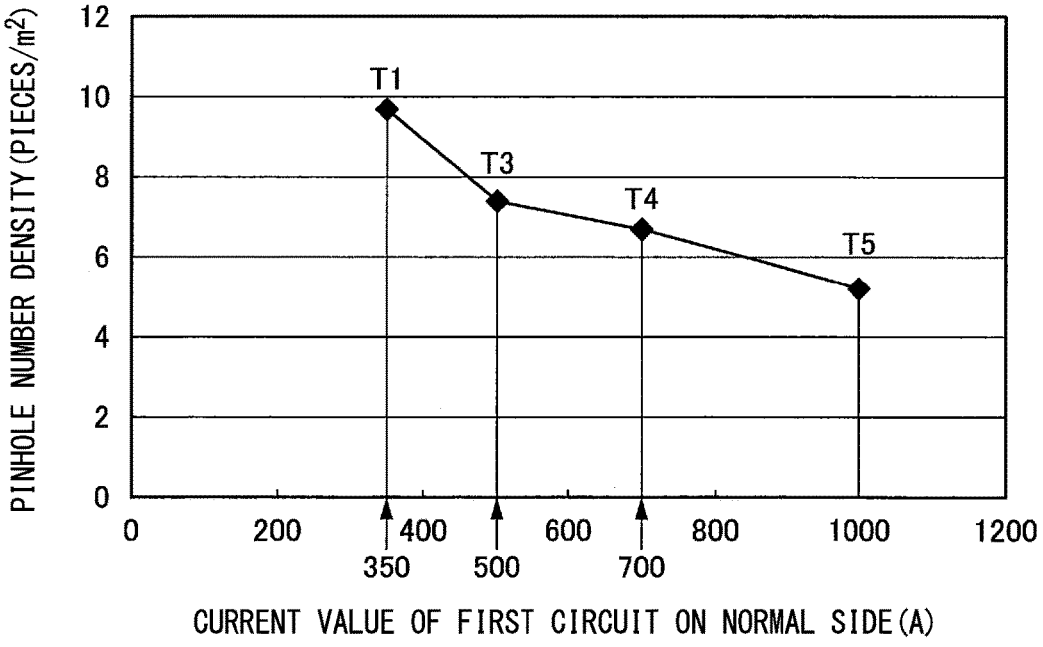
FIG. 17 is a view illustrating a relationship between the current value of the current flowing through a first circuit on the normal side and a pinhole number density in the actual machine test.

FIG. 17 illustrates a result of the actual machine test. FIG. 17 is a view illustrating a relationship between the current value of the current flowing through the first circuit 181*a* on the normal side and the pinhole number density in the actual machine test. The pinhole number density is the number of pinholes per unit area in the surface layer of the slab 3, and the lower the pinhole number density, the better the quality of the slab 3. Specifically, the pinhole number density is preferably 8 (holes/$m^2$) or lower.

From FIG. 17, it is understood that the pinhole number density decreases as the first circuit 181*a* on the normal side rises. Therefore, it was confirmed that the pinhole number density decreased as the difference in induction voltage between the circuits decreased. It is considered that this is because behavior of the discharge flow bounced up by the electromagnetic brake device 160 approaches behavior symmetrical on both sides of the immersion nozzle 6 in the mold long side direction due to suppression of the drift of the discharge flow as the difference in induction voltage between the circuits decreases. From such a result, it was confirmed that the quality of the slab 3 may be further improved by appropriately suppressing the drift according to the control for suppressing the drift of the discharge flow according to this embodiment.

Also, with reference to FIG. 17, it was confirmed that the pinhole number density was 8 (pieces/$m^2$) or lower as for each portion of the slab 3 which passes through the mold 110 at times T3, T4, and T5 at which the current value of the first circuit 181*a* on the normal side is 500 A, 700 A, and 1,000 A, respectively. Therefore, with reference to FIGS. 12 and 17, for example, it was confirmed that by setting the ratio of the magnetic flux density of the magnetic flux generated on the normal side and the clogging side to 1.2 or larger, the drift of the discharge flow is effectively suppressed, and the quality of the slab 3 is effectively improved.

Herein, although an example of increasing the current value of the first circuit 181*a* on the normal side in a case where the drift of the discharge flow is detected is described above, it is more preferable to decrease the current value of the second circuit 181*b* on the clogging side in addition to increasing the current value of the first circuit 181*a* on the normal side. Since the magnetic flux density of the magnetic flux generated on the closing side in the mold 110 may be reduced by lowering the current value of the second circuit 181*b* on the closing side, the flow volume and flow speed of the discharge flow from the discharge hole 61 on the close side may be increased. As a result, the flow volume and flow speed of the discharge flow from the discharge hole 61 on the normal side may be more effectively decreased, so that the drift of the discharge flow may be more effectively suppressed.

The preferred embodiment of the present invention is described above in detail with reference to the accompanying drawings, but the present invention is not limited to such example. It is obvious that one of ordinary knowledge in the technical field to which the present invention belongs may achieve various variations or applications within the scope of the technical idea recited in claims, and, it is understood that they naturally belong to the technical scope of the present invention.

FIELD OF INDUSTRIAL APPLICATION

According to the present invention, it is possible to provide the mold equipment and the continuous casting method capable of further improving the quality of the slab.

BRIEF DESCRIPTION OF THE REFERENCE SYMBOLS

1 Continuous casting machine
2 Molten steel
3 Slab
3*a* Solidified shell
3*b* Unsolidified portion
4 Ladle
5 Tundish
6 Immersion nozzle
10 Mold equipment
61 Discharge hole
110 Mold
111 Long side mold plate
112 Short side mold plate
121, 122, 123 Backup plate
130 Upper water box
140 Lower water box
150 Electromagnetic stirring device
151 Case
152 Electromagnetic stirring core
153 Coil
160 Electromagnetic brake device
161 Case
162 Electromagnetic brake core
163 Coil
164 Tooth
165 Connecting unit
170 Electromagnetic force generating device
181*a* First circuit
181*b* Second circuit
182*a*, 182*b* Power supply device

183*a*, 183*b* Voltage sensor
185 Amplifier
187 Control device

What is claimed is:

1. A mold equipment comprising:

a mold for continuous casting at a speed exceeding 1.6 m/min.;

an electromagnetic brake device that applies an electromagnetic force in a direction to brake a discharge flow to the discharge flow of molten metal from an immersion nozzle into the mold;

a control device that includes a processor configured to control a power supply to the electromagnetic brake device; and an electromagnetic stirring device that applies an electromagnetic force for generating a swirling flow in a horizontal plane to the molten metal in the mold, the electromagnetic stirring device being installed above the electromagnetic brake device, wherein the immersion nozzle is provided with a pair of discharge holes of the molten metal on both sides in a mold long side direction of the mold, the electromagnetic brake device is installed on an outer side surface of each of a pair of long side mold plates in the mold, and is provided with an iron core including a pair of teeth provided so as to face the long side mold plate on both sides of the immersion nozzle in the mold long side direction, and coils wound around the respective teeth, the coils on one side in the mold long side direction of electromagnetic brake devices are connected in series in a first circuit, the coils on another side in the mold long side direction of the electromagnetic brake devices are connected in series in a second circuit, the processor is further configured to independently control voltage and current applied to each of the first and second circuits for each circuit, detect a drift of the discharge flow between the pair of discharge holes on the basis of the voltage applied to the coils in the first circuit and the voltage applied to the coils in the second circuit, and control the current flowing through the first circuit and the current flowing through the second circuit on the basis of the detection result, and an electromagnetic force generating device is provided with the electromagnetic stirring device and the electromagnetic brake device, the electromagnetic stirring core and the electromagnetic brake core being configured such that the height H1 of the electromagnetic stirring core and the height H2 of the electromagnetic brake core satisfy expression (8)

$$0.43 \leq H1/H2 \quad \text{Expression (8), and}$$

the electromagnetic stirring core is arranged at a height position facing the discharge hole of the immersion nozzle, and the electromagnetic brake core is arranged below the discharge hole of the immersion nozzle.

2. The mold equipment according to claim 1, wherein the processor is further configured to detect the drift on the basis of a difference between an electromotive force generated in the first circuit due to a change over time in a flow state of the discharge flow from the discharge hole on one side in the mold long side direction and an electromotive force generated in the second circuit due to a change over time in a flow state of the discharge flow from the discharge hole on the other side in the mold long side direction, and control, in a case of detecting the drift, the current flowing through the first circuit and the current flowing through the second circuit such that the difference between the electromotive force generated in the first circuit and the electromotive force generated in the second circuit becomes small.

3. The mold equipment according to claim 2, further comprising:

an electromagnetic stirring device that applies an electromagnetic force for generating a swirling flow in a horizontal plane to the molten metal in the mold, the electromagnetic stirring device installed above the electromagnetic brake device.

4. The mold equipment according to claim 1, further comprising:

an electromagnetic stirring device that applies an electromagnetic force for generating a swirling flow in a horizontal plane to the molten metal in the mold, the electromagnetic stirring device installed above the electromagnetic brake device.

5. The mold equipment according to claim 1, wherein the discharge holes of the immersion nozzle are provided so as to be inclined downward from an inner peripheral surface side to an outer peripheral surface side of the immersion nozzle.

* * * * *